US008898055B2

(12) United States Patent
Hirose et al.

(10) Patent No.: US 8,898,055 B2
(45) Date of Patent: Nov. 25, 2014

(54) VOICE QUALITY CONVERSION DEVICE AND VOICE QUALITY CONVERSION METHOD FOR CONVERTING VOICE QUALITY OF AN INPUT SPEECH USING TARGET VOCAL TRACT INFORMATION AND RECEIVED VOCAL TRACT INFORMATION CORRESPONDING TO THE INPUT SPEECH

(75) Inventors: Yoshifumi Hirose, Kyoto (JP); Takahiro Kamai, Kyoto (JP); Yumiko Kato, Osaka (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 1527 days.

(21) Appl. No.: 12/307,021

(22) PCT Filed: May 8, 2008

(86) PCT No.: PCT/JP2008/001160

§ 371 (c)(1),
(2), (4) Date: Dec. 30, 2008

(87) PCT Pub. No.: WO2008/142836

PCT Pub. Date: Nov. 27, 2008

(65) Prior Publication Data

US 2009/0281807 A1 Nov. 12, 2009

(30) Foreign Application Priority Data

May 14, 2007 (JP) ..... 2007-128555

(51) Int. Cl.

| | |
|---|---|
| ***G10L 19/00*** | (2013.01) |
| ***G10L 19/02*** | (2013.01) |
| ***G10L 21/00*** | (2013.01) |
| ***G10L 21/02*** | (2013.01) |
| ***G10L 13/04*** | (2013.01) |
| *G10L 13/00* | (2006.01) |
| *G10L 21/013* | (2013.01) |

(52) U.S. Cl.

CPC ..... *G10L 21/00* (2013.01); *G10L 13/043* (2013.01); *G10L 2021/0135* (2013.01)

USPC ..... 704/203; 704/200; 704/261

(58) Field of Classification Search

USPC ..... 704/200–203, 231–242, 246–257, 704/258–260, 261, 262–269, 278, 704/E17.001–E17.016, E19.001–E19.049, 704/E13.001–E13.04

See application file for complete search history.

(56) References Cited

U.S. PATENT DOCUMENTS

| | | | | | |
|---|---|---|---|---|---|
| 3,786,188 | A * | 1/1974 | Allen | ..... | 704/263 |
| 4,058,676 | A * | 11/1977 | Wilkes et al. | ..... | 704/220 |
| 4,264,783 | A * | 4/1981 | Gagnon | ..... | 704/261 |
| 4,435,832 | A * | 3/1984 | Asada et al. | ..... | 704/262 |
| 4,703,505 | A * | 10/1987 | Seiler et al. | ..... | 704/268 |
| 4,707,858 | A * | 11/1987 | Fette | ..... | 704/251 |
| 4,720,861 | A * | 1/1988 | Bertrand | ..... | 704/222 |
| 4,813,076 | A * | 3/1989 | Miller | ..... | 704/254 |
| 4,827,516 | A * | 5/1989 | Tsukahara et al. | ..... | 704/224 |
| 4,979,216 | A * | 12/1990 | Malsheen et al. | ..... | 704/260 |
| 5,007,095 | A * | 4/1991 | Nara et al. | ..... | 704/261 |
| 5,327,518 | A * | 7/1994 | George et al. | ..... | 704/211 |
| 5,327,521 | A * | 7/1994 | Savic et al. | ..... | 704/272 |
| 5,463,715 | A * | 10/1995 | Gagnon | ..... | 704/267 |
| 5,522,013 | A * | 5/1996 | Vanska | ..... | 704/255 |
| 5,617,507 | A * | 4/1997 | Lee et al. | ..... | 704/200 |
| 5,633,983 | A * | 5/1997 | Coker | ..... | 704/260 |
| 5,642,368 | A * | 6/1997 | Gerson et al. | ..... | 714/786 |
| 5,717,819 | A * | 2/1998 | Emeott et al. | ..... | 704/221 |
| 5,758,023 | A * | 5/1998 | Bordeaux | ..... | 704/232 |
| 6,064,960 | A * | 5/2000 | Bellegarda et al. | ..... | 704/260 |
| 6,125,344 | A * | 9/2000 | Kang et al. | ..... | 704/207 |
| 6,240,384 | B1 * | 5/2001 | Kagoshima et al. | ..... | 704/220 |
| 6,308,156 | B1 * | 10/2001 | Barry et al. | ..... | 704/268 |
| 6,332,121 | B1 * | 12/2001 | Kagoshima et al. | ..... | 704/262 |
| 6,400,310 | B1 * | 6/2002 | Byrnes et al. | ..... | 342/115 |
| 6,470,316 | B1 * | 10/2002 | Chihara | ..... | 704/267 |
| 6,597,787 | B1 * | 7/2003 | Lindgren et al. | ..... | 379/406.05 |
| 6,766,299 | B1 * | 7/2004 | Bellomo et al. | ..... | 704/276 |
| 6,795,807 | B1 * | 9/2004 | Baraff | ..... | 704/271 |

| | | | | |
|---|---|---|---|---|
| 6,847,932 | B1 * | 1/2005 | Ashimura et al. | 704/266 |
| 7,065,485 | B1 * | 6/2006 | Chong-White et al. | 704/208 |
| 7,272,556 | B1 * | 9/2007 | Aguilar et al. | 704/230 |
| 7,328,154 | B2 * | 2/2008 | Mutel et al. | 704/245 |
| 7,454,343 | B2 * | 11/2008 | Hirose et al. | 704/256 |
| 2002/0032563 | A1 * | 3/2002 | Kamai et al. | 704/207 |
| 2002/0128839 | A1 * | 9/2002 | Lindgren et al. | 704/258 |
| 2002/0184006 | A1 * | 12/2002 | Yoshioka et al. | 704/205 |
| 2003/0088417 | A1 * | 5/2003 | Kamai et al. | 704/258 |
| 2004/0199383 | A1 * | 10/2004 | Kato et al. | 704/219 |
| 2004/0260552 | A1 * | 12/2004 | Navratil et al. | 704/269 |
| 2005/0060153 | A1 * | 3/2005 | Gable et al. | 704/246 |
| 2005/0119890 | A1 * | 6/2005 | Hirose | 704/260 |
| 2005/0171774 | A1 * | 8/2005 | Applebaum et al. | 704/250 |
| 2007/0203702 | A1 * | 8/2007 | Hirose et al. | 704/256 |
| 2007/0233489 | A1 * | 10/2007 | Hirose et al. | 704/258 |
| 2008/0091425 | A1 * | 4/2008 | Kane | 704/246 |
| 2008/0208599 | A1 * | 8/2008 | Rosec et al. | 704/278 |
| 2008/0288258 | A1 * | 11/2008 | Jiang et al. | 704/261 |
| 2009/0089051 | A1 * | 4/2009 | Ishii et al. | 704/225 |
| 2009/0204395 | A1 * | 8/2009 | Kato et al. | 704/206 |
| 2009/0281807 | A1 * | 11/2009 | Hirose et al. | 704/254 |
| 2010/0004934 | A1 * | 1/2010 | Hirose et al. | 704/261 |
| 2010/0204990 | A1 * | 8/2010 | Hirose et al. | 704/243 |
| 2010/0217584 | A1 * | 8/2010 | Hirose et al. | 704/206 |

FOREIGN PATENT DOCUMENTS

| | | |
|---|---|---|
| JP | 63-63100 | 3/1988 |
| JP | 5-257494 | 10/1993 |
| JP | 7-72900 | 3/1995 |
| JP | 63-63100 | 3/1998 |
| JP | 10-97267 | 4/1998 |
| JP | 2001-282300 | 10/2001 |
| JP | 2005-134685 | 5/2005 |
| JP | 2005-189483 | 7/2005 |
| JP | 2005-266349 | 9/2005 |
| JP | 2007-50143 | 3/2007 |

OTHER PUBLICATIONS

International Search Report issued Aug. 12, 2008 in the International (PCT) Application of which the present application is the U.S. National Stage.

Takahiro Ohtsuka and Hideki Kasuya, "*Robust ARX-based Speech Analysis Method Taking Voicing Source Pulse Train into Account*", The Journal of the Acoustical Society of Japan, vol. 58, No. 7, (2002), pp. 386-397.

* cited by examiner

*Primary Examiner* — Pierre-Louis Desir

*Assistant Examiner* — David Kovacek

(74) *Attorney, Agent, or Firm* — Wenderoth, Lind & Ponack, L.L.P.

(57) ABSTRACT

A voice quality conversion device including: a target vowel vocal tract information hold unit holding target vowel vocal tract information of each vowel indicating target voice quality; a vowel conversion unit (i) receiving vocal tract information with phoneme boundary information of the speech including information of phonemes and phoneme durations, (ii) approximating a temporal change of vocal tract information of a vowel in the vocal tract information with phoneme boundary information applying a first function, (iii) approximating a temporal change of vocal tract information of the same vowel held in the target vowel vocal tract information hold unit applying a second function, (iv) calculating a third function by combining the first function with the second function, and (v) converting the vocal tract information of the vowel applying the third function; and a synthesis unit synthesizing a speech using the converted information.

21 Claims, 23 Drawing Sheets

0%
(original)

100%
(target)

50%
(result)

VOICE QUALITY CONVERSION DEVICE AND VOICE QUALITY CONVERSION METHOD FOR CONVERTING VOICE QUALITY OF AN INPUT SPEECH USING TARGET VOCAL TRACT INFORMATION AND RECEIVED VOCAL TRACT INFORMATION CORRESPONDING TO THE INPUT SPEECH

TECHNICAL FIELD

The present invention relates to voice quality conversion devices and voice quality conversion methods for converting voice quality of a speech to another voice quality. More particularly, the present invention relates to a voice quality conversion device and a voice quality conversion method for converting voice quality of an input speech to voice quality of a speech of a target speaker.

BACKGROUND ART

In recent years, development of speech synthesis technologies has allowed synthetic speeches to have significantly high sound quality.

However, conventional applications of synthetic speeches are mainly reading of news texts by broadcaster-like voice, for example.

In the meanwhile, in services of mobile telephones and the like, a speech having a feature (a synthetic speech having a high individuality reproduction, or a synthetic speech with prosody/voice quality having features such as high school girl delivery or Japanese Western dialect) has begun to be distributed as one content. For example, service of using a message spoken by a famous person instead of a ring-tone is provided. In order to increase entertainments in communication between individuals as the above example, a desire for generating a speech having a feature and presenting the generated speech to a listener will be increased in the future.

A method of synthesizing a speech is broadly classified into the following two methods: a waveform connection speech synthesis method of selecting appropriate speech elements from prepared speech element databases and connecting the selected speech elements to synthesize a speech; and an analytic-synthetic speech synthesis method of analyzing a speech and synthesizing a speech based on a parameter generated by the analysis.

In consideration of varying voice quality of a synthetic speech as mentioned previously, the waveform connection speech synthesis method needs to have speech element databases corresponding to necessary kinds of voice qualities and connect the speech elements while switching among the speech element databases. This requires a significant cost to generate synthetic speeches having various voice qualities.

On the other hand, the analytic-synthetic speech synthesis method can convert voice quality of a synthetic speech by converting an analyzed speech parameter. An example of a method of converting such a parameter is a method of converting the parameter using two different utterances both of which are related to the same utterance content.

Patent Reference 1 discloses an example of an analytic-synthetic speech synthesis method using learning models such as a neural network.

FIG. 1 is a diagram showing a configuration of a speech processing system using an emotion addition method of Patent Reference 1.

The speech processing system shown in FIG. 1 includes an acoustic analysis unit 2, a spectrum Dynamic Programming (DP) matching unit 4, a phoneme-based duration extending/shortening unit 6, a neural network unit 8, a rule-based synthesis parameter generation unit, a duration extending/shortening unit, and a speech synthesis system unit. The speech processing system has the neural network unit 8 perform learning in order to convert an acoustic feature parameter of a speech without emotion into an acoustic feature parameter of a speech with emotion, and then adds emotion to the speech without emotion using the learned neural network unit 8.

The spectrum DP matching unit 4 examines a degree of similarity between a speech without emotion and a speech with emotion regarding feature parameters of spectrum among feature parameters extracted by the acoustic analysis unit 2 with time, then determines a temporal correspondence between identical phonemes, and thereby calculates a temporal extending/shortening rate of the speech with emotion to the speech without emotion for each phoneme.

The phoneme-based duration extending/shortening unit 6 temporally normalizes a time series of feature parameters of the speech with emotion to match the speech without emotion, according to the temporal extending/shortening rate for each phoneme generated by the spectrum DP matching unit 4.

In the learning, the neural network unit 8 learns differences between (i) acoustic feature parameters of the speech without emotion provided to an input layer with time and (ii) acoustic feature parameters of the speech with emotion provided to an output layer.

In addition, in the emotion addition, the neural network unit 8 performs calculation to estimate acoustic feature parameters of the speech with emotion from the acoustic feature parameters of the speech without emotion provided to the input layer with time, using weighting factors in a network decided in the learning. The above converts the speech without emotion to the speech with emotion based on the learning model.

However, the technology of Patent Reference 1 needs to record the same content as a predetermined learning text by speaking the content with a target emotion. Therefore, when the technology of Patent Reference 1 is used to speaker conversion, all of the predetermined learning text needs to be spoken by a target speaker. This causes a problem of increasing a load on the target speaker.

A method by which such a predetermined learning text does not need to be spoken is disclosed in Patent Reference 2. By the method disclosed in Patent Reference 2, the same content as a target speech is synthesized by a text-to-speech synthesis device, and a conversion function of a speech spectrum shape is generated using a difference between the synthesized speech and the target speech.

FIG. 2 is a block diagram of a voice quality conversion device of Patent Reference 2.

A speech signals of a target speaker is provided to a target speaker speech receiving unit 11*a*, and the speech recognition unit 19 performs speech recognition on the speech of the target speaker (hereinafter, referred to as a "target-speaker speech") provided to the target speaker speech receiving unit 11*a* and provides a pronunciation symbol sequence receiving unit 12*a* with a spoken content of the target-speaker speech together with pronunciation symbols. The speech synthesis unit 14 generates a synthetic speech using a speech synthesis database in a speech synthesis data storage unit 13 according to the provided pronunciation symbol sequence. The target speaker speech feature parameter extraction unit 15 analyzes the target-speaker speech and extracts feature parameters, and the synthetic speech feature parameter extraction unit 16 analyzes the generated synthetic speech and extracts feature parameters. The conversion function generation unit 17 generates functions for converting a spectrum shape of the synthetic speech to a spectrum shape of the target-speaker speech using both of the feature parameters. The voice quality conversion unit 18 converts voice quality of the input signals applying the generated conversion functions.

As described above, since a result of the speech recognition of the target-speaker speech is provided to the speech synthesis unit 14 as a pronunciation symbol sequence used for synthetic speech generation, a user does not need to provide a pronunciation symbol sequence by inputting a text or the like, which makes it possible to automate the processing.

Moreover, a speech synthesis device that can generate a plurality kinds of voice quality using a small amount of memory capacity is disclosed in Patent Reference 3. The speech synthesis device according to Patent Reference 3 includes an element storage unit, a plurality of vowel element storage units, and a plurality of pitch storage units. The element storage unit holds consonant elements including glide parts of vowels. Each of the vowel element storage units holds vowel elements of a single speaker. Each of the pitch storage units holds a fundamental pitch of the speaker corresponding to the vowel elements.

The speech synthesis device reads out vowel elements of a designated speaker from the plurality of vowel element storage units, and connects predetermined consonant elements stored in the element storage unit so as to synthesize a speech. Thereby, it is possible to convert voice quality of an input speech to voice quality of the designated speaker.

Patent Reference 1: Japanese Unexamined Patent Application Publication No. 7-72900 (pages 3-8, FIG. 1)

Patent Reference 2: Japanese Unexamined Patent Application Publication No. 2005-266349 (pages 9-10, FIG. 2)

Patent Reference 3: Japanese Unexamined Patent Application Publication No. 5-257494

SUMMARY OF THE INVENTION

Problems that Invention is to Solve

In the technology of Patent Reference 2, a content spoken by a target speaker is recognized by the speech recognition unit 19 to generate a pronunciation symbol sequence, and the speech synthesis unit 14 synthesizes a synthetic speech using data held in the standard speech synthesis data storage unit 13. However, the technology of Patent Reference 2 has a problem of inevitability of general errors in the recognition of the speech recognition unit 19, and it is therefore unavoidable that the problem significantly affects the performance of a conversion function generated by the conversion function generation unit 17. Moreover, the conversion function generated by the conversion function generation unit 17 is used for conversion from voice quality of a speech held in the speech synthesis data storage unit 13 to voice quality of a target speaker. Therefore, when input signals that are to be converted by the voice quality conversion unit 18 are not regarding voice quality that is identical or quite similar to the voice quality in the speech synthesis data storage unit 13, there is a problem that resulting converted output signals do not always match the voice quality of the target speaker.

In the meanwhile, the speech synthesis device according to Patent Reference 3 performs the voice quality conversion on an input speech by switching a voice quality feature to another for one frame of a target vowel. Therefore, the speech synthesis device according to Patent Reference 3 can convert the voice quality of the input speech only to voice quality of a previously registered speaker, and fails to generate a speech having intermediate voice quality of a plurality of speakers. In addition, since the voice quality conversion uses only a voice quality feature of one frame, there is a problem of significant deterioration in naturalness of consecutive utterances.

Furthermore, the speech synthesis device according to Patent Reference 3 has a situation where a difference between a consonant feature that has been uniquely decided and a vowel feature after conversion is increased when the vowel feature is converted to a considerably different feature due to vowel element replacement. In such a situation, even if interpolation is performed between the vowel feature and the consonant feature to decrease the above difference, there is a problem of significant deterioration in naturalness of a resulting synthetic speech.

Thus, the present invention overcomes the problems of the conventional techniques as described above. It is an object of the present invention to provide a voice quality conversion method and a voice quality conversion method by both of which voice quality conversion can be performed without any restriction on input signals to be converted.

It is another object of the present invention to provide a voice quality conversion method and a voice quality conversion device by both of which voice quality conversion can be performed on input original signals to be converted, without being affected by recognition errors on an utterance of a target speaker.

Means to Solve the Problems

In accordance with an aspect of the present invention, there is provided a voice quality conversion device that converts voice quality of an input speech using information corresponding to the input speech, the voice quality conversion device including: a target vowel vocal tract information hold unit configured to hold target vowel vocal tract information that is vocal tract information of each vowel and that indicates target voice quality; a vowel conversion unit configured to (i) receive vocal tract information with phoneme boundary information which is vocal tract information that corresponds to the input speech and that is added with information of (1) a phoneme in the input speech and (2) a duration of the phoneme, (ii) approximate a temporal change of vocal tract information of a vowel included in the vocal tract information with phoneme boundary information applying a first function, (iii) approximate a temporal change of vocal tract information that is regarding a same vowel as the vowel and that is held in the target vowel vocal tract information hold unit applying a second function, (iv) calculate a third function by combining the first function with the second function, and (v) convert the vocal tract information of the vowel applying the third function; and a synthesis unit configured to synthesize a speech using the vocal tract information converted for the vowel by the vowel conversion unit.

With the above structure, the vocal tract information is converted using the target vowel vocal tract information held in the target vowel vocal tract information hold unit. Therefore, since the target vowel vocal tract information can be used as an absolute target, voice quality of an original speech to be converted is not restricted at all and speeches having any voice quality can be inputted. In other words, restriction on input original speech is extremely low, which makes it possible to convert voice quality for various speeches.

It is preferable that the voice quality conversion device further includes a consonant vocal tract information derivation unit configured to (i) receive the vocal tract information with phoneme boundary information, and (ii) derive vocal tract information that is regarding a same consonant as each consonant held in the vocal tract information with phoneme boundary information, from pieces of vocal tract information that are regarding consonants having voice quality which is not the target voice quality, wherein the synthesis unit is configured to synthesize the speech using (i) the vocal tract information converted for the vowel by the vowel conversion unit and (ii) the vocal tract information derived for the each consonant by the consonant vocal tract information derivation unit.

It is further preferable that the consonant vocal tract information derivation unit includes: a consonant vocal tract information hold unit configured to hold, for each consonant, pieces of vocal tract information extracted from speeches of a plurality of speakers; and a consonant selection unit configured to (i) receive the vocal tract information with phoneme boundary information, and (ii) select the vocal tract information that is regarding the same consonant as each consonant held in the vocal tract information with phoneme boundary information and that is suitable for the vocal tract information converted by the vowel conversion unit for a vowel positioned at a vowel section prior or subsequent to the each consonant, from among the pieces of vocal tract information of the consonants held in the vocal tract information with phoneme boundary information.

It is still further preferable that the consonant selection unit is configured to (i) receive the vocal tract information with phoneme boundary information, and (ii) select the vocal tract information that is regarding the same consonant as each consonant held in the vocal tract information with phoneme boundary information, from among the pieces of vocal tract information of the consonants held in the vocal tract information with phoneme boundary information, based on continuity between a value of the selected vocal tract information and a value of the vocal tract information converted by the vowel conversion unit for the vowel positioned at the vowel section prior to or subsequent to the each consonant.

With the above structure, it is possible to use an optimum consonant vocal tract information suitable for the converted voice tract information of the vowel.

It is still further preferable that the voice quality conversion device further includes a conversion ratio receiving unit configured to receive a conversion ratio representing a degree of conversion to the target voice quality, wherein the vowel conversion unit is configured to (i) receive the vocal tract information with phoneme boundary information and the conversion ratio received by the conversion ratio receiving unit, (ii) approximate the temporal change of the vocal tract information of the vowel included in the vocal tract information with phoneme boundary information applying the first function, (iii) approximate the temporal change of the vocal tract information that is regarding the same vowel as the vowel and that is held in the target vowel vocal tract information hold unit applying the second function, (iv) calculate the third function by combining the first function with the second function at the conversion ratio, and (v) convert the vocal tract information of the vowel applying the third function.

With the above structure, it is possible to control a degree of emphasis of the target voice quality.

It is still further preferable that the target vowel vocal tract information hold unit is configured to hold the target vowel vocal tract information that is generated by: a stable vowel section extraction unit configured to detect a stable vowel section from a speech having the target voice quality; and a target vocal tract information generation unit configured to extract, from the stable vowel section, the vocal tract information as the target vowel vocal tract information.

Further, as the vocal tract information of the target voice quality, only vocal tract information regarding a stable vowel section may be held. Furthermore, in recognizing an utterance of the target speaker, phoneme recognition may be performed only on the vowel stable section. Thereby, recognition errors do not occur for the utterance of the target speaker. As a result, voice quality conversion can be performed on input original signals to be converted, without being affected by recognition errors on the utterance of the target speaker.

In accordance with another aspect of the present invention, there is provided a voice quality conversion system that converts voice quality of an original speech to be converted using information corresponding to the original speech, the voice quality conversion system including: a server; and a terminal connected to the server via a network. The server includes: a target vowel vocal tract information hold unit configured to hold target vowel vocal tract information that is vocal tract information of each vowel and that indicates target voice quality; a target vowel vocal tract information sending unit configured to send the target vowel vocal tract information held in the target vowel vocal tract information hold unit to the terminal via the network; an original speech hold unit configured to hold original speech information that is information corresponding to the original speech; and an original speech information sending unit configured to send the original speech information held in the original speech hold unit to the terminal via the network. The terminal includes: a target vowel vocal tract information receiving unit configured to receive the target vowel vocal tract information from the target vowel vocal tract information sending unit; an original speech information receiving unit configured to receive the original speech information from the original speech information sending unit; a vowel conversion unit configured to: approximate, applying a first function, a temporal change of vocal tract information of a vowel included in the original speech information received by the original speech information receiving unit; approximate, applying a second function, a temporal change of the target vowel vocal tract information that is regarding a same vowel as the vowel and that is received by the target vowel vocal tract information receiving unit; calculate a third function by combining the first function with the second function; and convert the vocal tract information of the vowel applying the third function; and a synthesis unit configured to synthesize a speech using the vocal tract information converted for the vowel by the vowel conversion unit.

A user using the terminal can download the original speech information and the target vowel vocal tract information, and then perform voice quality conversion on the original speech information using the terminal. For example, when the original speech information is an audio content, the user can reproduce the audio content by voice quality which the user likes.

In accordance with still another aspect of the present invention, there is provided a voice quality conversion system that converts voice quality of an original speech to be converted using information corresponding to the original speech, the voice quality conversion system including: a terminal; and a server connected to the terminal via a network. The terminal includes: a target vowel vocal tract information generation unit configured to generate target vowel vocal tract information that is vocal tract information of each vowel and that indicates target voice quality; a target vowel vocal tract information sending unit configured to send the target vowel vocal tract information generated by the target vowel vocal tract information generation unit to the server via the network; a voice quality conversion speech receiving unit configured to receive a speech with converted voice quality; and a reproduction unit configured to reproduce the speech with the converted voice quality received by the voice quality conversion speech receiving unit. The the server includes: an original speech hold unit configured to hold original speech information that is information corresponding to the original speech; a target vowel vocal tract information receiving unit configured to receive the target vowel vocal tract information from the target vowel vocal tract information sending unit; a vowel conversion unit configured to: approximate, applying a first function, a temporal change of vocal tract information of a vowel included in the original speech information held in the original speech information hold unit; approximate, applying a second function, a temporal change of the target vowel vocal tract information that is regarding a same vowel as the vowel and that is received by the target vowel vocal tract information receiving unit; calculate a third function by combining the first function with the second function; and convert the vocal tract information of the vowel applying the third function; a synthesis unit configured to synthesize a speech using the vocal tract information converted for the vowel by the vowel conversion unit; and a synthetic speech sending unit configured to send, as the speech with the converted voice quality, the speech synthesized by the synthesis unit to the voice quality conversion speech receiving unit via the network.

The terminal generates and sends the target vowel vocal tract information, and receives and reproduces the speech with voice quality converted by the server. As a result, the vocal tract information which the terminal needs to generate is only regarding target vowels, which significantly reduces a processing load. In addition, the user of the terminal can listen to an audio content which the user likes by voice quality which the user likes.

It should be noted that the present invention can be implemented not only as the voice quality conversion device including the above characteristic units, but also as: a voice quality conversion method including steps performed by the characteristic units of the voice quality conversion device: a program causing a computer to execute the characteristic steps of the voice quality conversion method; and the like. Of course, the program can be distributed by a recording medium such as a Compact Disc-Read Only Memory (CD-ROM) or by a transmission medium such as the Internet.

Effects of The Invention

According to the present invention, all that is necessary as information of a target speaker is information of vowel stable sections only, which can significantly reduce a load on the target speaker. For example, in Japanese language, merely five vowels are prepared. As a result, the voice conversion can be easily performed.

In addition, since vocal tract information regarding only a vowel stable section is specified as information of a target speaker, it is not necessary to recognize a whole utterance of a target speaker as the conventional technology of Patent Reference 2 does, and influence of speech recognition errors is low.

Furthermore, in the conventional technology of Patent Reference 2, a conversion function is generated according to a difference between elements of the speech synthesis unit and an utterance of a target speaker, voice quality of an original speech to be converted needs to be identical or similar to voice quality of elements held in the speech synthesis unit. However, the voice quality conversion device according to the present invention uses vowel vocal tract information of a target speaker as a target of an absolute value. Thereby, any desired voice quality of original speeches to be converted can be inputted without restriction. In other words, restriction on input original speech is extremely low, which makes it possible to convert voice quality for various speeches.

Furthermore, since only information regarding a vowel stable section can be held as information of a target speaker, an amount of memory capacity may be extremely small. Therefore, the present invention can be used in portable terminals, services via networks, and the like.

NUMERICAL REFERENCES

Figure 1:
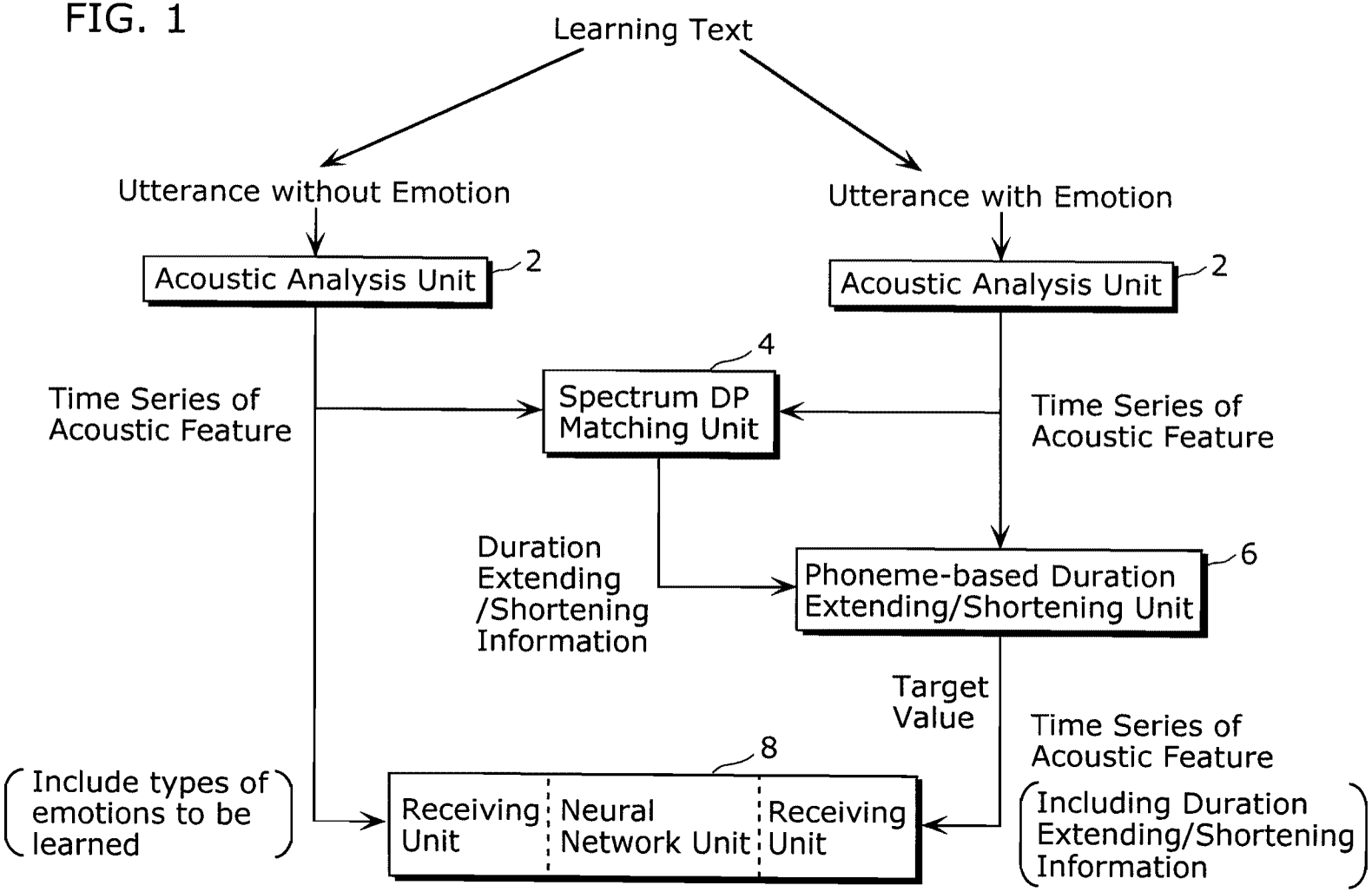
FIG. 1 is a diagram showing a configuration of a conventional speech processing system.
Figure 2:
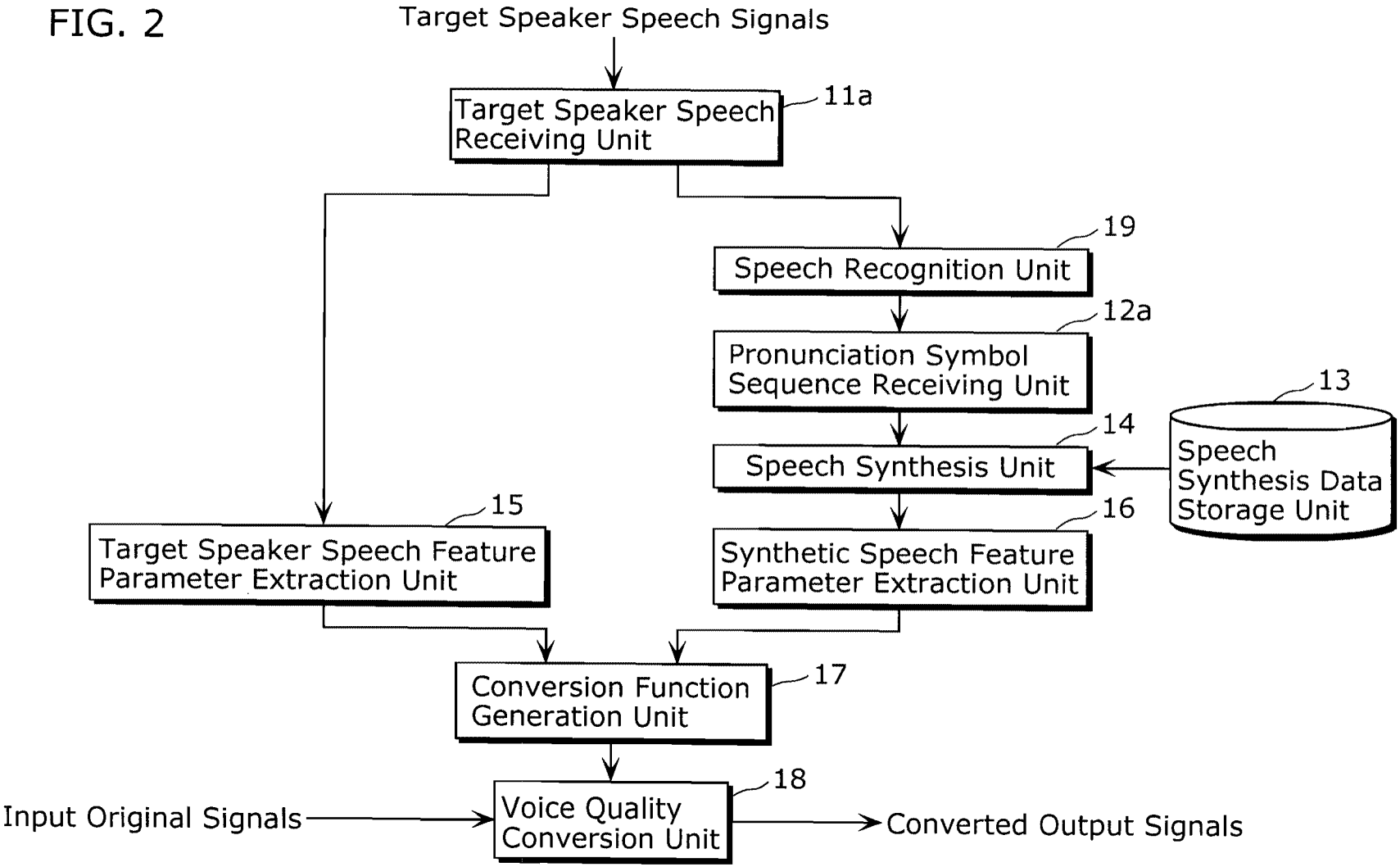
FIG. 2 is a diagram showing a structure of a conventional voice quality conversion device.

101 target vowel vocal tract information hold unit
102 conversion ratio receiving unit
103 vowel conversion unit
104 consonant vocal tract information hold unit
105 consonant selection unit
106 consonant transformation unit
107 synthesis unit
111 original speech hold unit
112 original speech information sending unit
113 target vowel vocal tract information sending unit
114 original speech information receiving unit
115 target vowel vocal tract information receiving unit
121 original speech server
122 target speech server
201 target speaker speech
202 phoneme recognition unit
203 vowel stable section extraction unit
204 target vocal tract information generation unit
301 LPC analysis unit
302 PARCOR calculation unit
303 ARX analysis unit
401 text-to-speech synthesis device

DETAILED DESCRIPTION OF THE INVENTION

The following describes embodiments of the present invention with reference to the drawings.

(First Embodiment)

Figure 3:
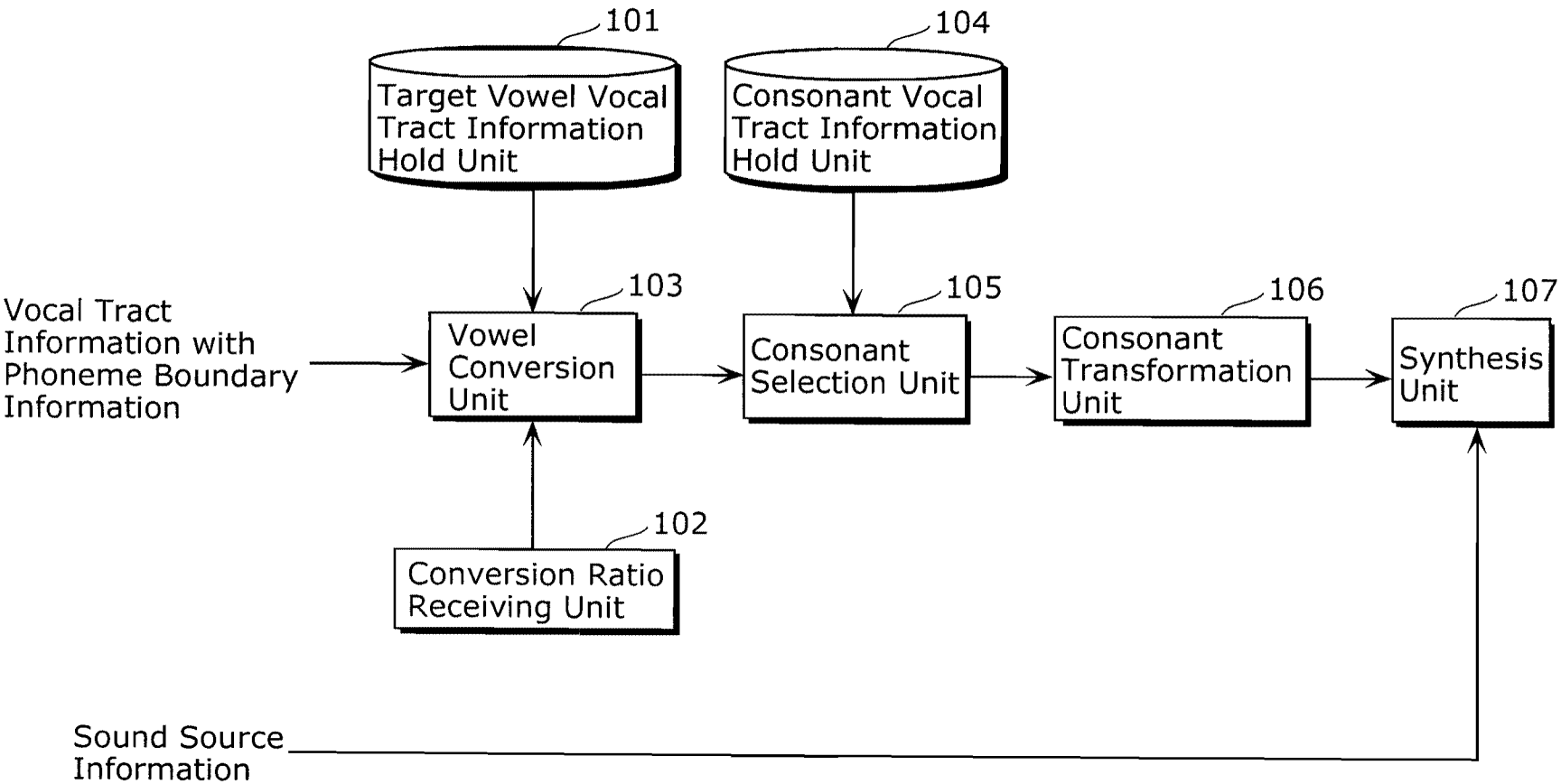
FIG. 3 is a diagram showing a structure of a voice quality conversion device according to a first embodiment of the present invention.

FIG. 3 is a diagram showing a structure of a voice quality conversion device according to a first embodiment of the present invention.

The voice quality conversion device according to the first embodiment is a device that converts voice quality of an input speech by converting vocal tract information of vowels of the input speech to vocal tract information of vowels of a target speaker at a provided conversion ratio. This voice quality conversion device includes a target vowel vocal tract information hold unit 101, a conversion ratio receiving unit 102, a vowel conversion unit 103, a consonant vocal tract information hold unit 104, a consonant selection unit 105, a consonant transformation unit 106, and a synthesis unit 107.

The target vowel vocal tract information hold unit 101 is a storage device that holds vocal tract information extracted from each of vowels uttered by a target speaker. Examples of the target vowel vocal tract information hold unit 101 are a hard disk, a memory, and the like.

The conversion ratio receiving unit 102 is a processing unit that receives a conversion ratio to be used in voice quality conversion into voice quality of the target speaker.

The vowel conversion unit 103 is a processing unit that converts, for each vowel section included in received vocal tract information with phoneme boundary information, vocal tract information of the vowel section to vocal tract information held in the target vowel vocal tract information hold unit 101 and corresponding to the vowel section, based on the conversion ratio provided from the conversion ratio receiving unit 102. Here, the vocal tract information with phoneme boundary information is vocal tract information regarding an input speech added with a phoneme label. The phoneme label includes (i) information regarding each phoneme in the input speech (hereinafter, referred to as "phoneme information") and (ii) information of a duration of the phoneme. A method of generating the vocal tract information with phoneme boundary information will be described later.

The consonant vocal tract information hold unit 104 is a storage unit that holds vocal tract information which is extracted from speech data of a plurality of speakers and corresponds to consonants each related to an unspecified speaker. Examples of the consonant vocal tract information hold unit 104 includes a hard disk, a memory, and the like.

The consonant selection unit 105 is a processing unit that selects, from the consonant vocal tract information hold unit 104, vocal tract information of a consonant corresponding to vocal tract information of a consonant included in the vocal tract information with phoneme boundary information having vowel vocal tract information converted by the vowel conversion unit 103, based on pieces of vocal tract information of vowels prior and subsequent to the vocal tract information of the consonant included in the vocal tract information with phoneme boundary information.

The consonant transformation unit 106 is a processing unit that transforms the vocal tract information of the consonant selected by the consonant selection unit 105 depending on the vocal tract information of the vowels prior and subsequent to the consonant.

The synthesis unit 107 is a processing unit that synthesizes a speech based on (i) sound source information of the input speech and (ii) the vocal tract information with phoneme boundary information converted by the vowel conversion unit 103, the consonant selection unit 105, and the consonant transformation unit 106. More specifically, the synthesis unit 107 generates an excitation sound source based on the sound source information of the input speech, and synthesizes a speech by driving a vocal tract filter structured based on the vocal tract information with phoneme boundary information. A method of generating the sound source information will be described later.

The voice quality conversion device is implemented as a computer or the like, and each of the above-described processing units is implemented by executing a program by the computer.

Next, each element in the voice quality conversion device is described in more detail.

<Target Vowel Vocal Tract Information Hold Unit 101>

Figure 4:
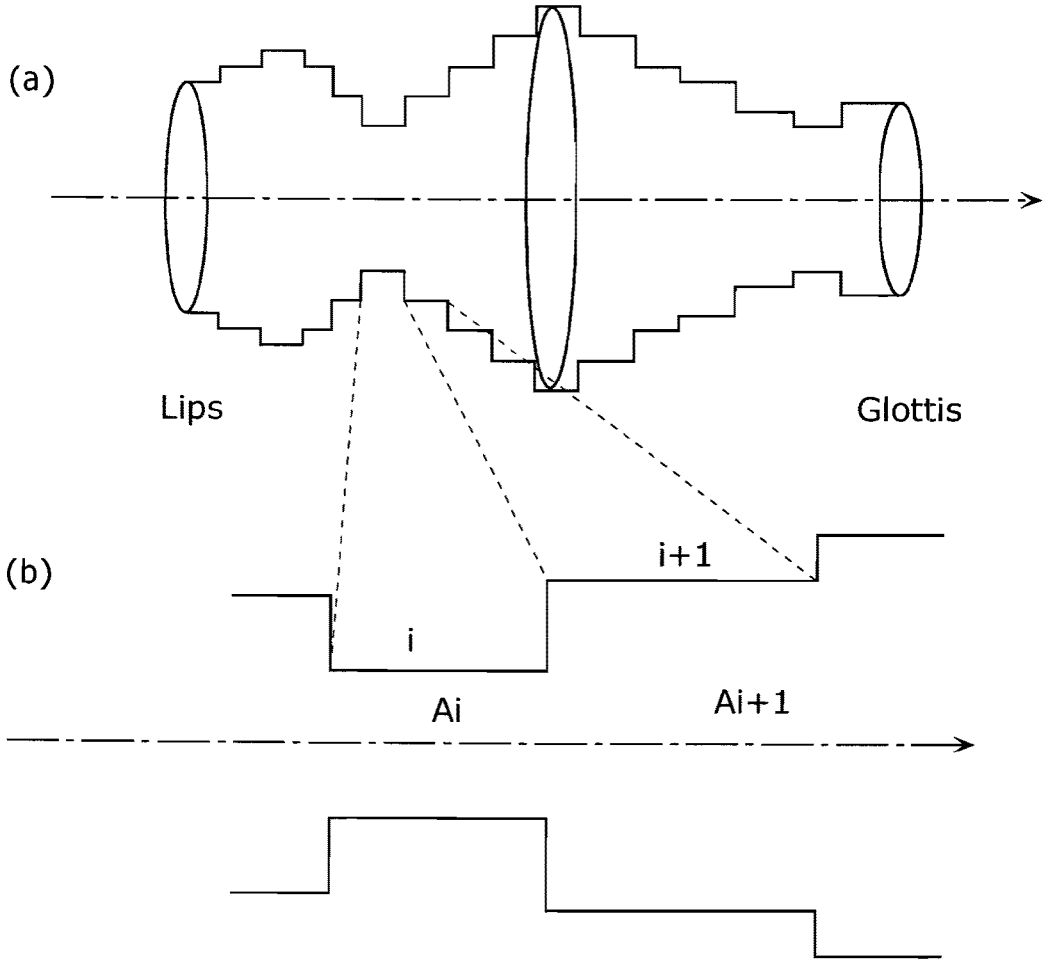
FIG. 4 is a diagram showing a relationship between a vocal tract sectional area function and a PARCOR coefficient.

For Japanese language, the target vowel vocal tract information hold unit 101 holds vocal tract information derived from a shape of a vocal tract (hereinafter, referred to as a "vocal tract shape") of a target speaker for each of at least five vowels (/aiueo/) of the target speaker. For other language such as English, the target vowel vocal tract information hold unit 101 may hold vocal tract information of each vowel in the same manner as described for Japanese language. An example of indication of vocal tract information is a vocal tract sectional area function. The vocal tract sectional area function represents one of sectional areas in an acoustic tube included in an acoustic tube model. The acoustic tube model simulates a vocal tract by acoustic tubes each having variable circular sectional areas as shown in FIG. 4 (*a*). It is known that such a sectional area uniquely corresponds to a partial auto correlation (PARCOR) coefficient based on Linear Predictive Coding (LPC) analysis. A sectional area can be converted according to the below equation 1. It is assumed in the embodiments that a piece of vocal tract information is represented by a PARCOR coefficient $k_i$. It should be noted that a piece of vocal tract information is hereinafter described as a PARCOR coefficient but a piece of vocal tract information is not limited to a PARCOR coefficient and may be a Line Spectrum Pairs (LSP) coefficient or a LPC equivalent to a PARCOR coefficient. It should also be noted that a relationship between (i) a reflection coefficient and (ii) the PARCOR coefficient between acoustic tubes in the acoustic tube model is merely inversion of a sign. Therefore, a piece of vocal tract information may be a represented by the reflection coefficient itself.

$$\frac{A_i}{A_{i+1}} = \frac{1-k_i}{1+k_i} \quad \text{[Formula 1]}$$

where $A_n$ represents a sectional area of an acoustic tube in an i-th section, and $k_i$ represents a PARCOR coefficient (reflection coefficient) at a boundary between the i-th section and an i+1-th section, as shown in FIG. 4 (*b*).

A PARCOR coefficient can be calculated using a linear predictive coefficient $\alpha_i$ analyzed by LPC analysis. More specifically, a PARCOR coefficient can be calculated using Levinson-Durbin-Itakura algorithm. Moreover, a PARCOR coefficient has the following characteristics.

- While a linear predictive coefficient depends on an analysis order p, a PARCOR coefficient does not depend on an order of analysis.
- A lower-order coefficient has greater fluctuation influence on a spectrum, and a higher-order coefficient has smaller fluctuation influence on the spectrum.
- Fluctuation of an high-order coefficient evenly influences all frequency bands.

Next, a method of generating a piece of vocal tract information regarding a vowel of a target speaker (hereinafter, referred to as "target vowel vocal tract information") is described with reference to an example. Pieces of target vowel vocal tract information are generated from isolate vowel voices uttered by a target speaker, for example.

Figure 5:
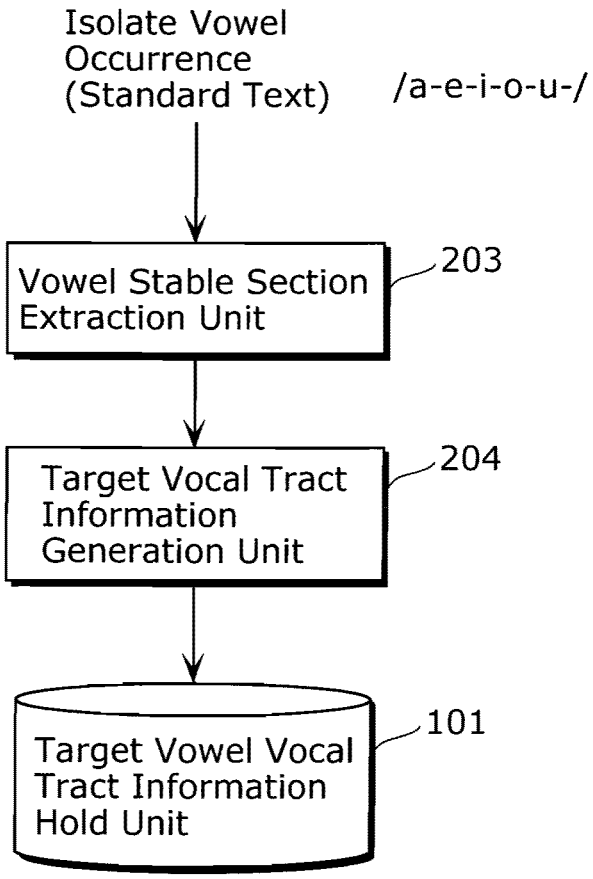
FIG. 5 is a diagram showing a structure of processing units for generating target vowel vocal tract information held in a target vowel vocal tract information hold unit.

FIG. 5 is a diagram showing a structure of processing units for generating pieces of target vowel vocal tract information held in the target vowel vocal tract information hold unit 101 from isolate vowel voices uttered by a target speaker.

A vowel stable section extraction unit 203 extracts sections of isolate vowels from the provided isolate vowel voices. A method of the extraction is not limited. For instance, a section having power at or above a certain level is decided as a stable section, and the stable section is extracted as a section of a vowel (hereinafter, referred to as a "vowel section").

For the vowel section extracted by the vowel stable section extraction unit 203, the target vocal tract information generation unit 204 calculates a PARCOR coefficient that has been explained above.

The processing of the vowel stable section extraction unit 203 and the target vocal tract information generation unit 204 is performed on voices uttering the provided isolate vowels, thereby generating information to be held in the target vowel vocal tract information hold unit 101.

Figure 6:
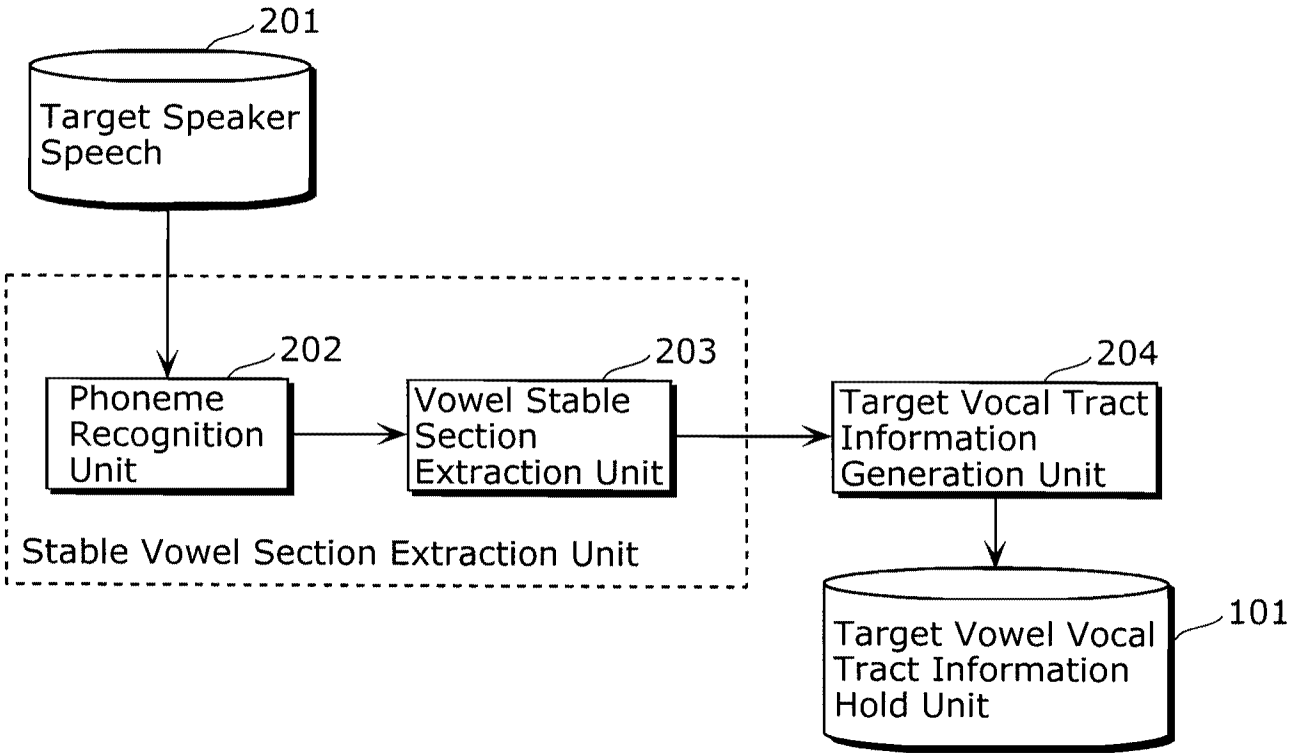
FIG. 6 is a diagram showing a structure of processing units for generating target vowel vocal tract information held in a target vowel vocal tract information hold unit.

For another example, information to be held in the target vowel vocal tract information hold unit 101 may be generated by processing units as shown in FIG. 6. An utterance of a target speaker is not limited to isolate vowel voices, as far as the utterance includes at least five vowels. For example, an utterance may be a speech which a target speaker utters at present or a speech which has been recorded. A speech such as singing data is also possible.

A phoneme recognition unit 202 performs phoneme recognition on a target speaker speech 201 that is an utterance of a target speaker. Next, a vowel stable section extraction unit 203 extracts a stable vowel section from the target speaker speech 201 based on the recognition result of the phoneme recognition unit 202. In the method of the extraction, for example, a section with high reliability of a recognition result of the phoneme recognition unit 202 (namely, a section with a high likelihood) may be used as a stable vowel section.

Figure 7:
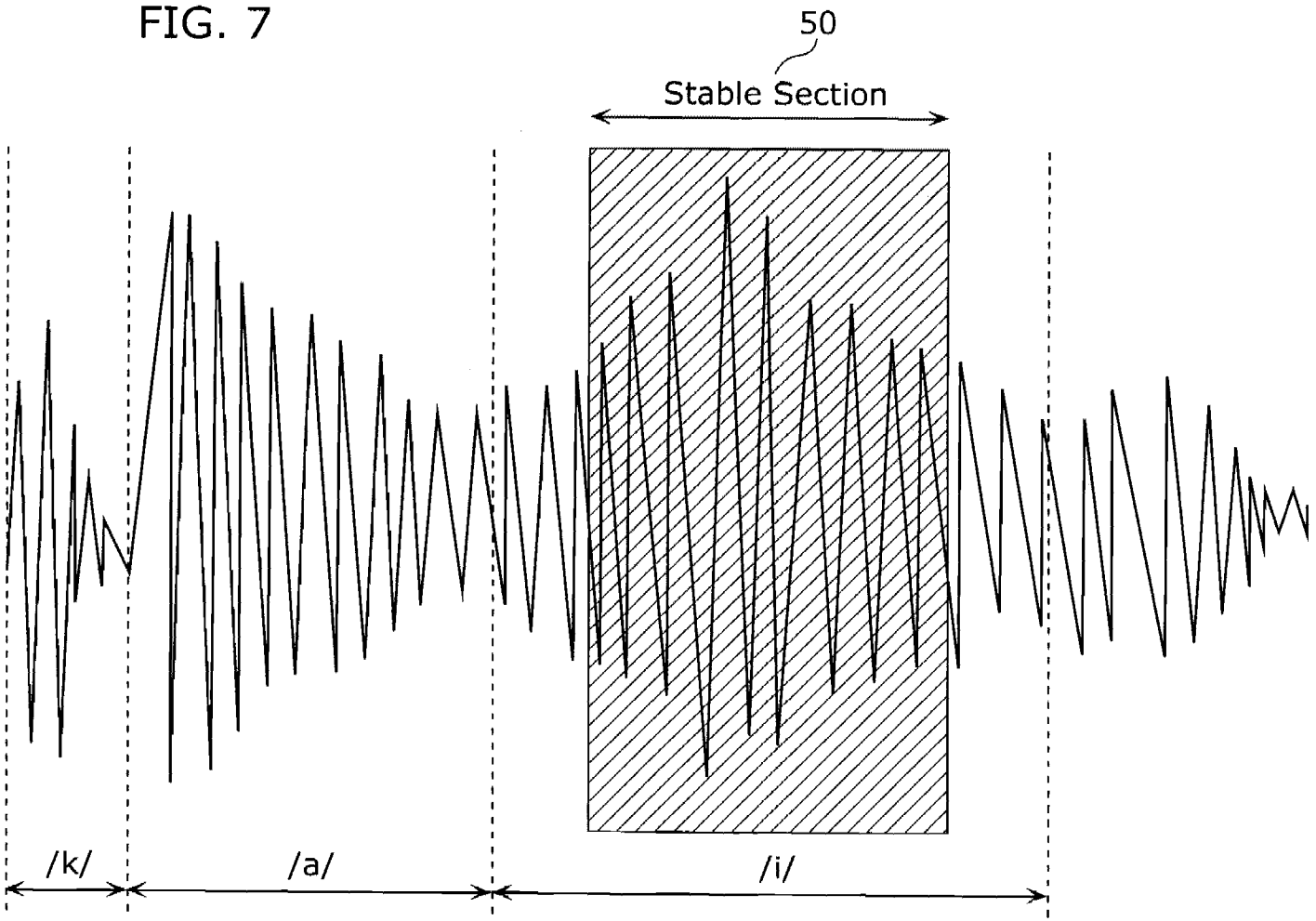
FIG. 7 is a diagram showing an example of a stable section of a vowel.

The extraction of stable vowel sections can eliminate influence of recognition errors occurred in the phoneme recognition unit 202. The following describes a situation where a speech (/k/, /a/, /i/) as shown in FIG. 7 is inputted and a stable section of a vowel section /i/ is extracted from the speech, for example. For instance, a section having great power in the vowel section /i/ can be decided as a stable section 50. Or, using a likelihood that is inside information of the phoneme recognition unit 202, a section having a likelihood equal to or greater than a threshold value may be used as a stable section.

A target vocal tract information generation unit 204 generates target vowel vocal tract information for the extracted vowel stable section, and stores the generated information to the target vowel vocal tract information hold unit 101. By the above processing, information held in the target vowel vocal tract information hold unit 101 is generated. The generation of the target vowel vocal tract information by the target vocal tract information generation unit 204 is performed by, for example, calculating a PARCOR coefficient that has been explained above.

It should be noted that the method of generating target vowel vocal tract information held in the target vowel vocal tract information hold unit 101 is not limited to the above but may be any methods for extracting vocal tract information for a stable vowel section.

<Conversion Ratio Receiving Unit 102>

The conversion ratio receiving unit 102 receives a conversion ratio for designating how much an input speech is to be converted to be similar to a speech of a target speaker. The conversion ratio is generally represented by a numeral value ranging from 0 to 1. As the conversion ratio is closer to 1, voice quality of a resulting converted speech will be more similar to voice quality of the target speaker, and as the conversion ratio is closer to 0, voice quality of a resulting converted speech will be more similar to the voice quality of the original speech to be converted.

It is also possible to express a difference between the voice quality of the original speech and the voice quality of the target speech with a more emphatic, by receiving a conversion ratio equal to or greater than 1. It is still possible to express the difference between the voice quality of the original speech and the voice quality of the target speech with an emphatic in the reverse direction, by receiving a conversion ratio equal to or less than 0 (namely, a conversion ratio having a negative value). It is still possible that a conversion ratio is not received but is set to a predetermined ratio.

<Vowel Conversion Unit 103>

The vowel conversion unit 103 converts pieces of vocal tract information regarding vowel sections included in provided vocal tract information with phoneme boundary information to corresponding pieces of target vocal tract information held in the target vowel vocal tract information hold unit 101 based on the conversion ratio designated by the conversion ratio receiving unit 102. The details of the conversion method are explained below.

The vocal tract information with phoneme boundary information is generated by generating, from an original speech, pieces of vocal tract information represented by PARCOR coefficients that have been explained above, and adding phoneme labels to the pieces of vocal tract information.

Figure 8A:
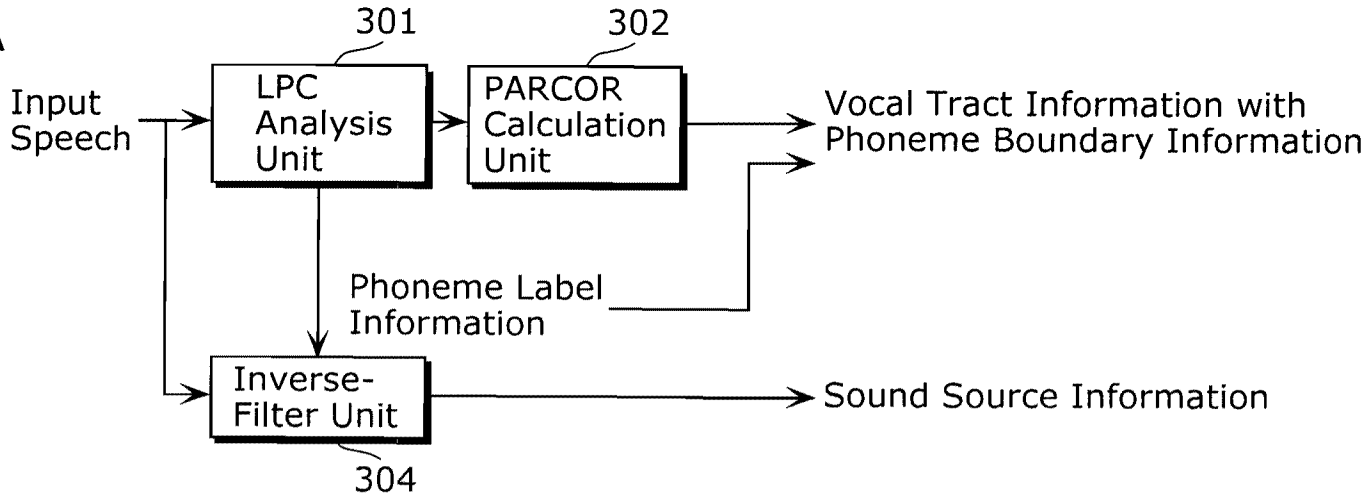
FIG. 8A is a diagram showing an example of a method of generating vocal tract information with phoneme boundary information to be provided.

More specifically, as shown in FIG. 8A, a LPC analysis unit 301 performs linear predictive analysis on the input speech and a PARCOR calculation unit 302 calculates PARCOR coefficients based on linear predictive coefficients generated in the analysis. Here, a phoneme label is added to the PARCOR coefficient separately.

On the other hand, the sound source information to be provided to the synthesis unit 107 is generated as follows. The inverse filter unit 304 forms a filter having a feature reversed from a frequency response according to a filter coefficient (linear predictive coefficient) generated in the analysis of the LPC analysis unit 301, and filters the input speech, thereby generating a sound source waveform (namely, sound source information) of the input speech.

Instead of the above-described LPC analysis, autoregressive with exogenous input (ARX) analysis may be used. The ARX analysis is a speech analysis method based on a speech generation process represented by an ARX model and a mathematical expression sound source model aimed for accurate estimation of vocal tract parameters and sound source parameters, achieving higher accurate separation between vocal tract information and sound source information than that of the LPC analysis (Non-Patent Reference: "Robust ARX-based Speech Analysis Method Taking Voicing Source Pulse Train into Account", Takahiro Ohtsuka et al., The Journal of the Acoustical Society of Japan, vol. 58, No. 7, (2002), pp. 386-397).

Figure 8B:
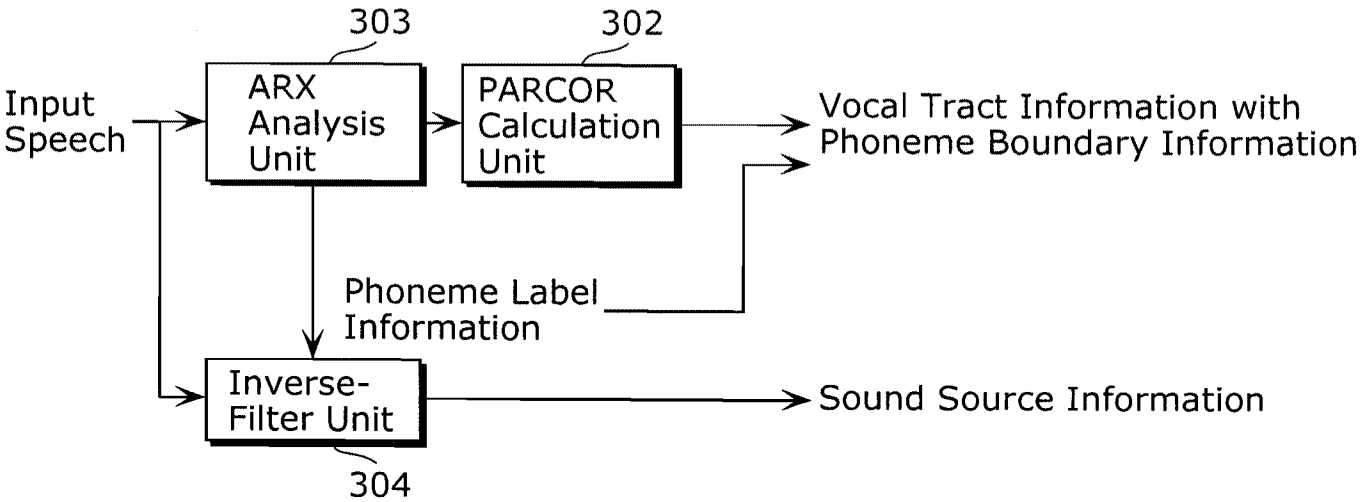
FIG. 8B is a diagram showing another example of a method of generating vocal tract information with phoneme boundary information to be provided.

FIG. 8B is a diagram showing another method of generating vocal tract information with phoneme boundary information.

As shown in FIG. 8B, an ARX analysis unit 303 performs ARX analysis on an input speech and the PARCOR calculation unit 302 calculates PARCOR coefficients based on a polynomial expression of an all-pole model generated in the analysis. Here, a phoneme label is added to the PARCOR coefficient separately.

On the other hand, sound source information to be provided to the synthesis unit 107 is generated by the same processing as that of the inverse filter unit 304 shown in FIG. 8A. More specifically, the inverse filter unit 304 forms a filter having a feature reversed from a frequency response according to a filter coefficient generated in the analysis of the ARX analysis unit 303 and filters the input speech, thereby generating a sound source waveform (namely, sound source information) of the input speech.

Figure 9:
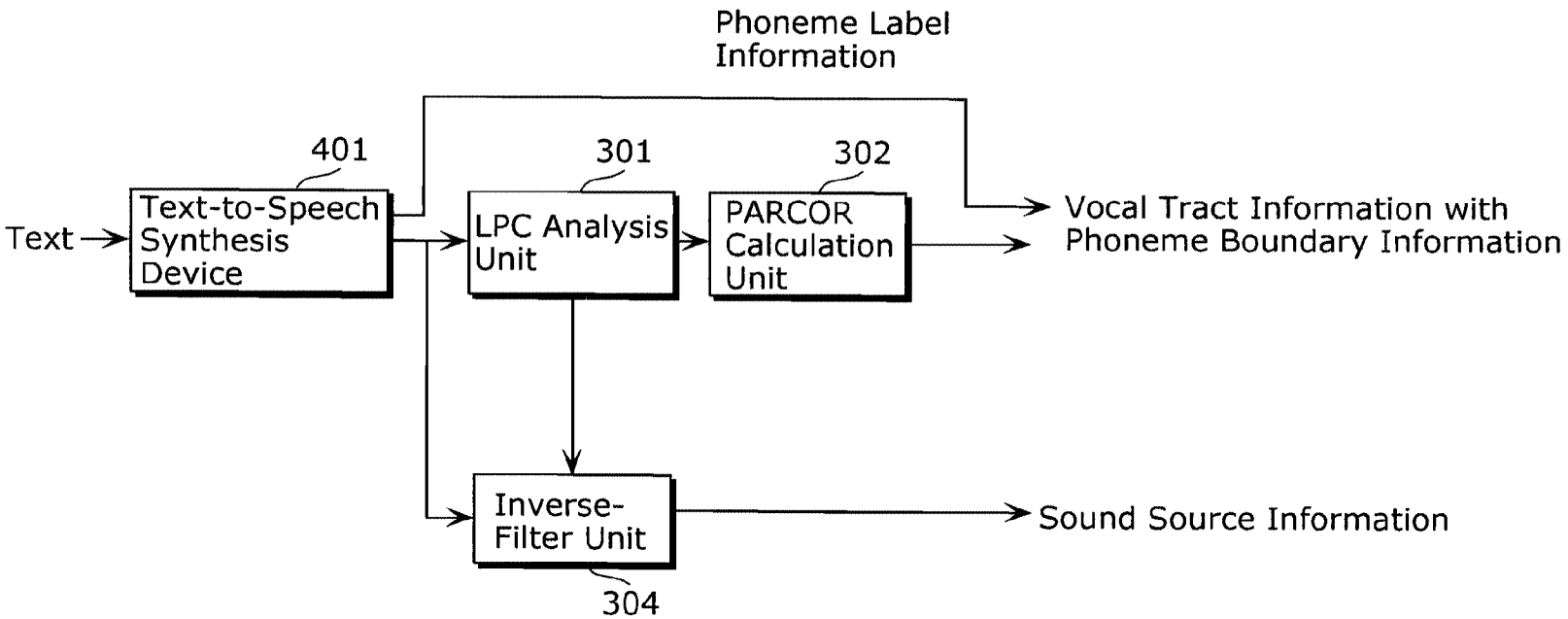
FIG. 9 is a diagram showing still another example of a method of generating vocal tract information with phoneme boundary information to be provided, using a text-to-speech synthesis device.
Figure 10A:
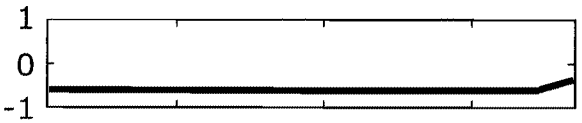
FIG. 10A is a graph showing an example of vocal tract information represented by a first-order PARCOR coefficient of a vowel /a/.
Figure 10B:
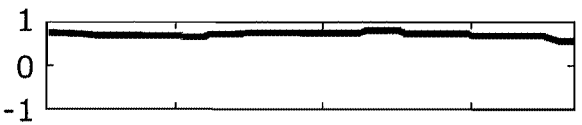
FIG. 10B is a graph showing an example of vocal tract information represented by a second-order PARCOR coefficient of a vowel /a/.
Figure 10C:
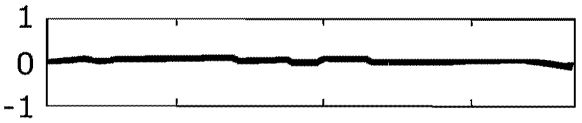
FIG. 10C is a graph showing an example of vocal tract information represented by a third-order PARCOR coefficient of a vowel /a/.
Figure 10D:
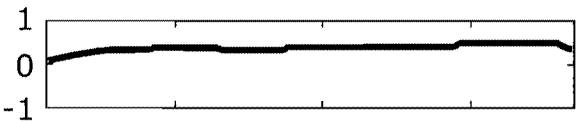
FIG. 10D is a graph showing an example of vocal tract information represented by a fourth-order PARCOR coefficient of a vowel /a/.
Figure 10E:
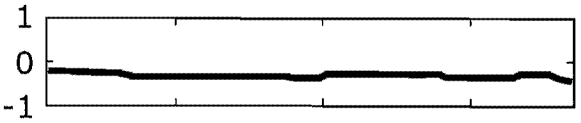
FIG. 10E is a graph showing an example of vocal tract information represented by a fifth-order PARCOR coefficient of vowel/a/.
Figure 10F:
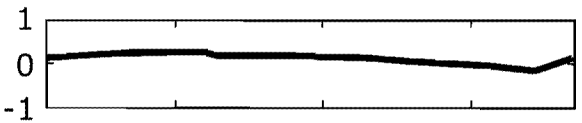
FIG. 10F is a graph showing an example of vocal tract information represented by a sixth-order PARCOR coefficient of a vowel /a/.
Figure 10G:
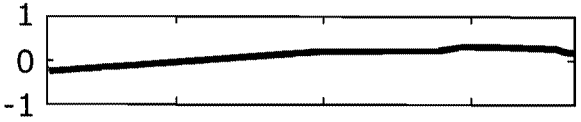
FIG. 10G is a graph showing an example of vocal tract information represented by a seventh-order PARCOR coefficient of a vowel /a/.
Figure 10H:
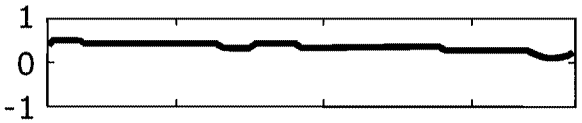
FIG. 10H is a graph showing an example of vocal tract information represented by an eighth-order PARCOR coefficient of a vowel /a/.
Figure 10I:
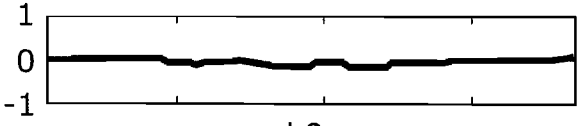
FIG. 10I is a graph showing an example of vocal tract information represented by a ninth-order PARCOR coefficient of a vowel /a/.
Figure 10J:
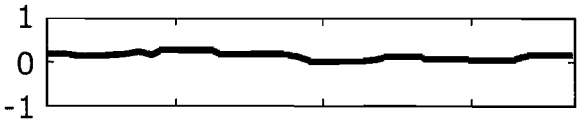
FIG. 10J is a graph showing an example of vocal tract information represented by a tenth-order PARCOR coefficient of a vowel /a/.
Figure 11A:
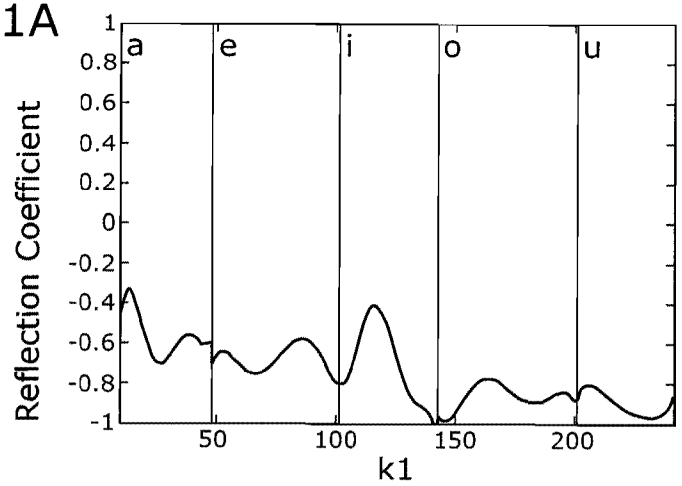
FIG. 11A is a graph showing an example of polynomial approximation of a vocal tract shape of a vowel used in a vowel conversion unit.
Figure 11B:
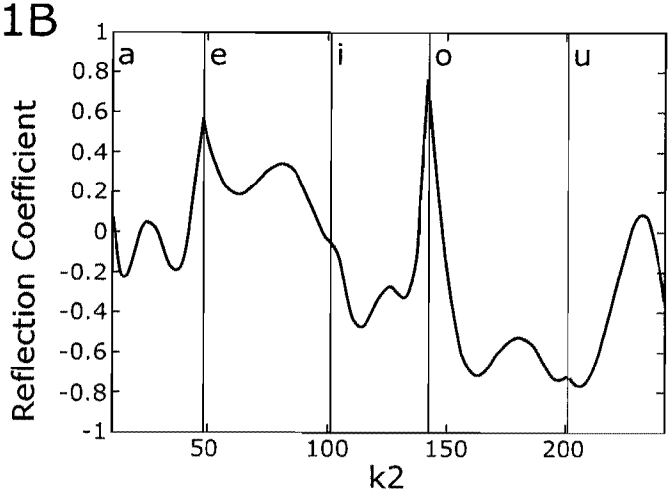
FIG. 11B is a graph showing another example of polynomial approximation of a vocal tract shape of a vowel used in the vowel conversion unit.
Figure 11C:
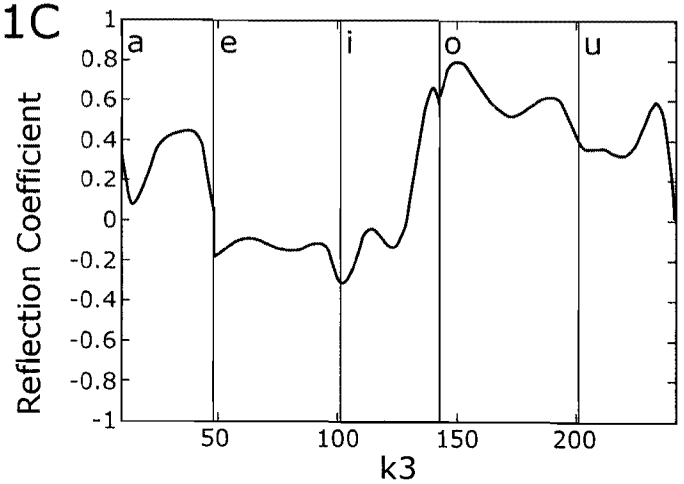
FIG. 11C is a graph showing still another example of polynomial approximation of a vocal tract shape of a vowel used in the vowel conversion unit.
Figure 11D:
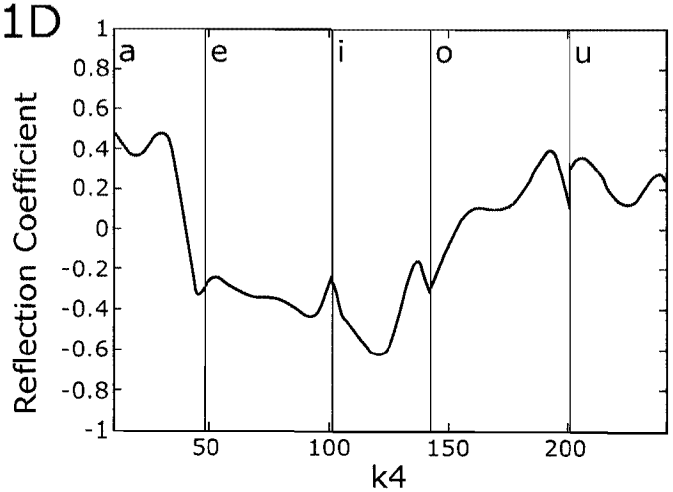
FIG. 11D is a graph showing still another example of polynomial approximation of a vocal tract shape of a vowel used in the vowel conversion unit.

FIG. 9 is a diagram showing still another method of generating the vocal tract information with phoneme boundary information.

As shown in FIG. 9, a text-to-speech synthesis device 401 synthesizes a speech from a provided text to output a synthetic speech. The synthetic speech is provided to the LPC analysis unit 301 and the inverse filter unit 304. Therefore, when an input speech is a synthetic speech synthesized by the text-to-speech synthesis device 401, phoneme labels can be obtained from the text-to-speech synthesis device 401. Moreover, the LPC analysis unit 301 and the PARCOR calculation unit 302 can easily calculate PARCOR coefficients using the synthetic speech.

On the other hand, sound source information to be provided to the synthesis unit 107 is generated by the same processing as that of the inverse filter unit 304 shown in FIG. 8A. More specifically, the inverse filter unit 304 forms a filter having a feature reversed from a frequency response from a filter coefficient generated in the analysis of the ARX analysis unit 303 and filters the input speech, thereby generating a sound source waveform (namely, sound source information) of the input speech.

It should be note that, when vocal tract information with phoneme boundary information is to be generated off-line from the voice quality conversion device, phoneme boundary information may be previously added to vocal tract information by a person.

FIGS. 10A to 10J are graphs showing examples of a piece of vocal tract information of a vowel /a/ represented by PARCOR coefficients of ten orders.

In the figures, a vertical axis represents a reflection coefficient, and a horizontal axis represents time. These figures show that a PARCOR coefficient moves relatively smoothly as time passes.

The vowel conversion unit 103 converts vocal tract information of each vowel included in vocal tract information with phoneme boundary information provided in the above-described manner.

Firstly, from the target vowel vocal tract information hold unit 101, the vowel conversion unit 103 receives target vowel vocal tract information corresponding to a piece of vocal tract information regarding a vowel to be converted. If there are plural pieces of target vowel vocal tract information corresponding to the vowel to be converted, the vowel conversion unit 103 selects an optimum target vowel vocal tract information depending on a state of phoneme environments (for example, kinds of prior and subsequent phonemes) of the vowel to be converted.

The vowel conversion unit 103 converts the vocal tract information of the vowel to be converted to the target vowel vocal tract information based on a conversion ratio provided from the conversion ratio receiving unit 102.

In the provided vocal tract information with phoneme boundary information, a time series of each order regarding the vocal tract information that is regarding a section of the vowel to be converted and represented by a PARCOR coefficient is approximated applying a polynomial expression (first function) shown in the below equation 2. For example, when a PARCOR coefficient has ten orders, a PARCOR coefficient of each order is approximated applying the polynomial expression shown in the equation 2. As a result, ten kinds of polynomial expressions can be generated. An order of the polynomial expression is not limited and an appropriate order can be set.

[Formula 2]

$$\hat{y}_a = \sum_{i=0}^{p} a_i x^i \qquad \text{Equation 2}$$

where $\hat{y}_a$ [Formula 3]

is an approximate polynomial expression of a PARCOR coefficient of an input original speech, $a_i$ [Formula 4]

is a coefficient of the polynomial expression, and $x$ [Formula 5]

expresses a time.

Regarding a unit on which the polynomial approximation is to be applied, a section of a single phoneme (phoneme section), for example, is set as a unit of approximation. The unit of approximation may be not the above phoneme section but a duration from a phoneme center to another phoneme center. In the following description, the unit of approximation is assumed to be a phoneme section.

Each of FIGS. 11A to 11D is a graph showing an example of first to fourth order PARCOR coefficients, when the PARCOR coefficients are approximated by a fifth-order polynomial expression and smoothed on a phoneme section basis in a time direction. A vertical axis and a horizontal axis of each figure represent the same as that of each of FIGS. 10A to 10J.

It is assumed in the first embodiment that an order of the polynomial expression is fifth order, but may be other order. It should be noted that a PARCOR coefficient may be approximated not only applying the polynomial expression but also using a regression line on a phoneme section basis.

Like a PARCOR coefficient of a vowel section to be converted, target vowel vocal tract information represented by a PARCOR coefficient held in the target vowel vocal tract information hold unit 101 is approximated applying a polynomial expression (second function) of the following equation 3, thereby calculating a coefficient $b_i$ of a polynomial expression.

[Formula 6]

$$\hat{y}_b = \sum_{i=0}^{p} b_i x^i \qquad \text{(Equation 3)}$$

Next, using an original speech parameter ($a_i$), a target vowel vocal tract information ($b_i$), and a conversion ratio (r), a coefficient of a polynomial expression of converted vocal tract information (PARCOR coefficients) is determined using the below equation 4.

$c_i$ [Formula 7]

The above is the coefficient.

[Formula 8]

$$c_i = a_i + (b_i - a_i) \times r \qquad \text{(Equation 4)}$$

In general, a conversion ratio r is designated within a range of $0 \le r \le 1$. However, even if a conversion ratio r exceeds the range, the coefficient can be determined by the equation 4. When a conversion ratio r exceeds a value of 1, the conversion is performed so that a difference between the original speech parameter ($a_i$) and the target vowel vocal tract information ($b_i$) is further emphasized. On the other hand, when a conversion ratio r is a negative value, the conversion is performed so that the difference between a original speech parameter ($a_i$) and the target vowel vocal tract information ($b_i$) is further emphasized in a reverse direction.

Using the calculated coefficient of the converted polynomial expression, converted vocal tract information is determined applying the below equation 5 (third function).

$c_i$ [Formula 9]

The above is calculated coefficient of the converted polynomial expression.

[Formula 10]

$$\hat{y}_c = \sum_{i=0}^{p} c_i x^i \qquad \text{(Equation 5)}$$

The above-described conversion processing is performed on a PARCOR coefficient of each order. As a result, the PARCOR coefficient can be converted to a target PARCOR coefficient at the designated conversion ratio.

Figure 12:
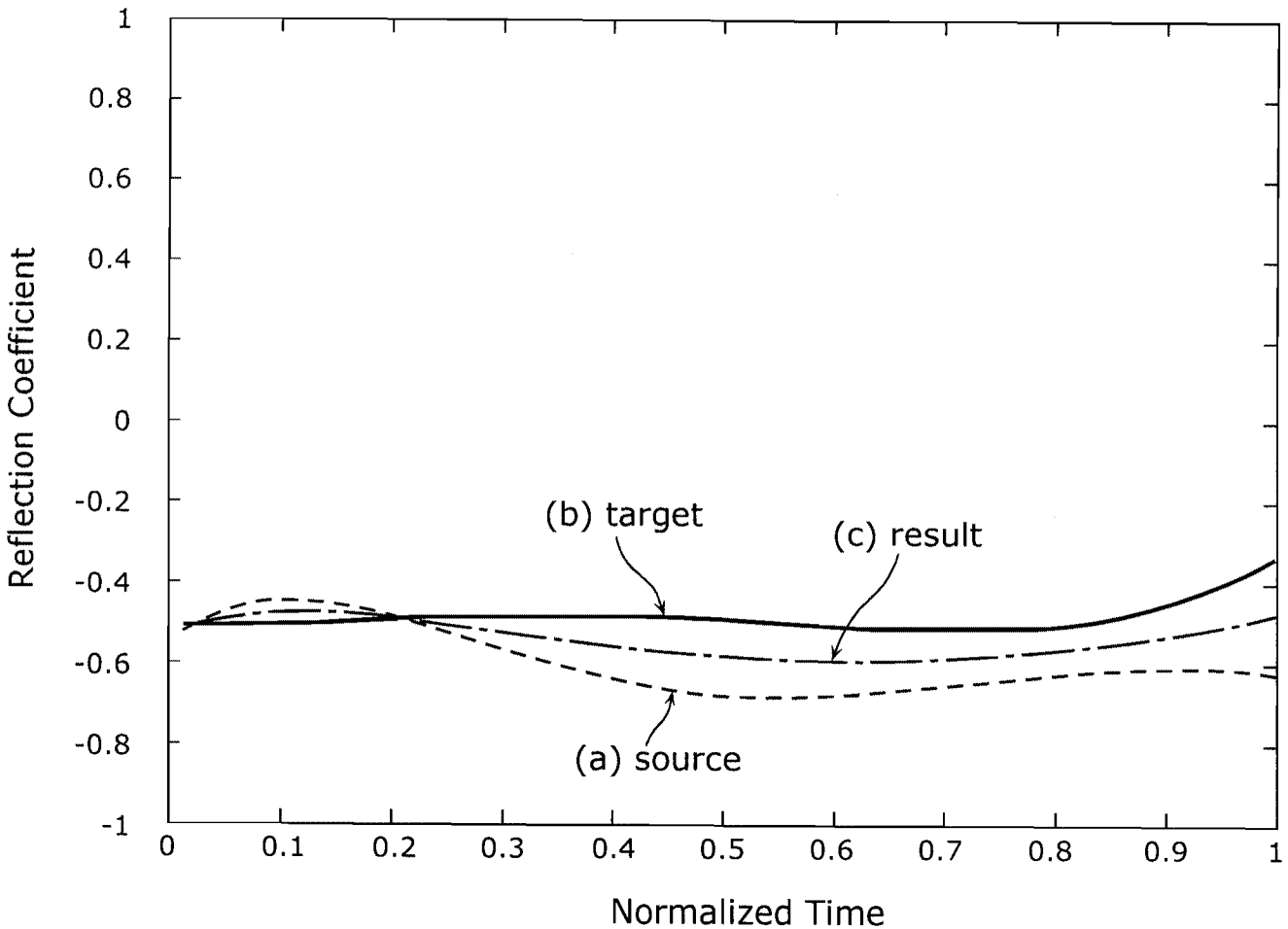
FIG. 12 is a graph showing how a PARCOR coefficient of a vowel section is converted by the vowel conversion unit.

An example of the above-described conversion performed on a vowel /a/ is shown in FIG. 12. In FIG. 12, a horizontal axis represents a normalized time, and a vertical axis represents a first-order PARCOR coefficient. The normalized time is a time duration of a vowel section which is a period from a time 0 to a time 1 by normalizing time. This is processing for adjusting a time axis when a duration of a vowel in an original speech (in other words, a source speech) is different from a duration of target vowel vocal tract information. (a) in FIG. 12 shows transition of a coefficient of an utterance /a/ of a male speaker uttering an original speech (source speech). On the other hand, (b) in FIG. 12 shows transition of a coefficient of an utterance /a/ of a female speaker uttering a target vowel. (c) shows transition of a coefficient generated by converting the coefficient of the male speaker to the coefficient of the female speaker at a conversion ratio of 0.5 using the above-described conversion method. As shown in FIG. 12, the conversion method can achieve interpolation of PARCOR coefficients between the speakers.

In order to prevent discontinuity of values of PARCOR coefficients at a phoneme boundary, interpolation is performed on the phoneme boundary by providing an appropriate glide section. The method for the interpolation is not limited. For example, linear interpolation can solve the problem of discontinuity of PARCOR coefficients.

Figure 13:
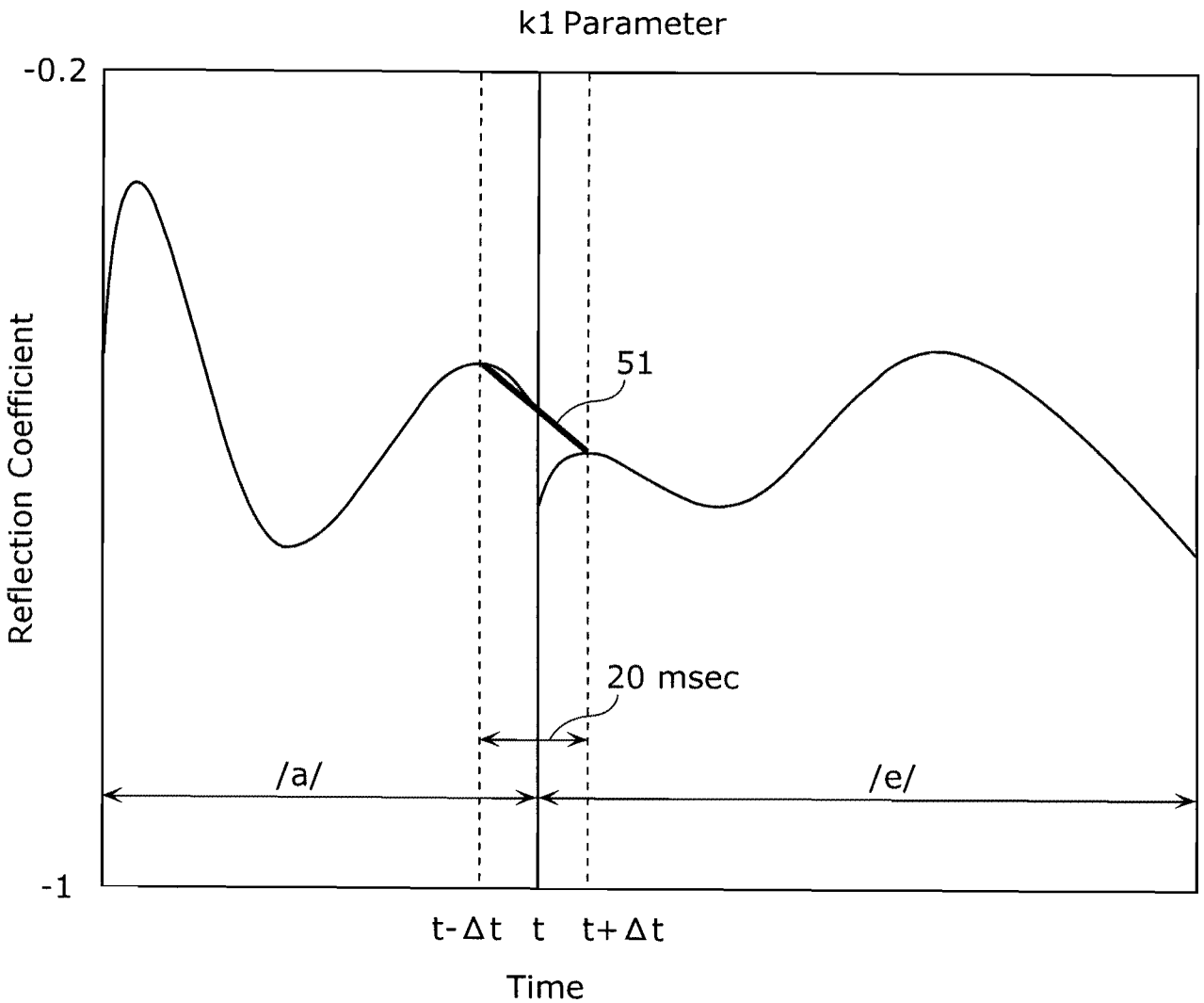
FIG. 13 is a graph for explaining an example of interpolating values of PARCOR coefficients by providing a glide section.

FIG. 13 is a graph for explaining an example of interpolating values of PARCOR coefficients by providing a glide section. FIG. 13 shows reflection coefficients at a connection boundary between a vowel /a/ and a vowel /e/. In FIG. 13, at a boundary time (t), the reflection coefficients are not continuous. Therefore, by setting appropriate glide times (Δt) counted from the boundary time, reflection coefficients from a time t−Δt to a time t+Δt are interpolated to be linear, thereby calculating a reflection coefficient 51 after the interpolation. As a result, the discontinuity of reflection coefficients at the phoneme boundary can be prevented. Each glide time may be set to about 20 msec, for example. It is also possible to change the glide time depending on durations of vowels before and after the glide time. For example, it is possible that a shorter glide section is set for a shorter vowel section and that a longer glide section is set for a longer vowel section.

Figure 14B:
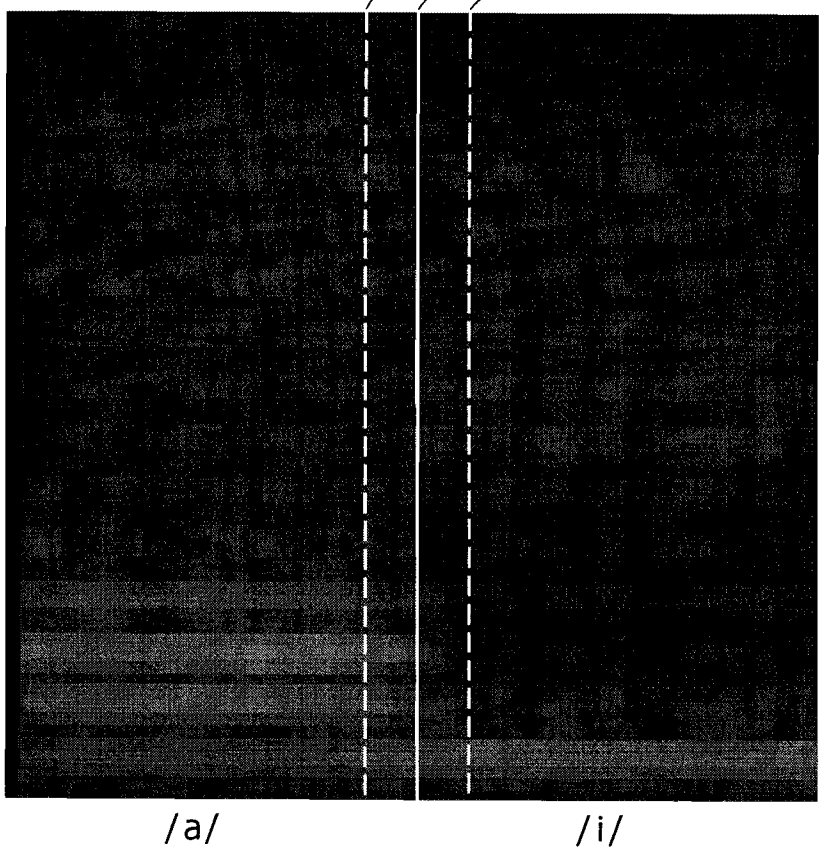
FIG. 14B is a graph showing a spectrum when voices at the boundary between the vowel /a/ and the vowel /i/ are connected to each other by cross-fade.
Figure 14A:
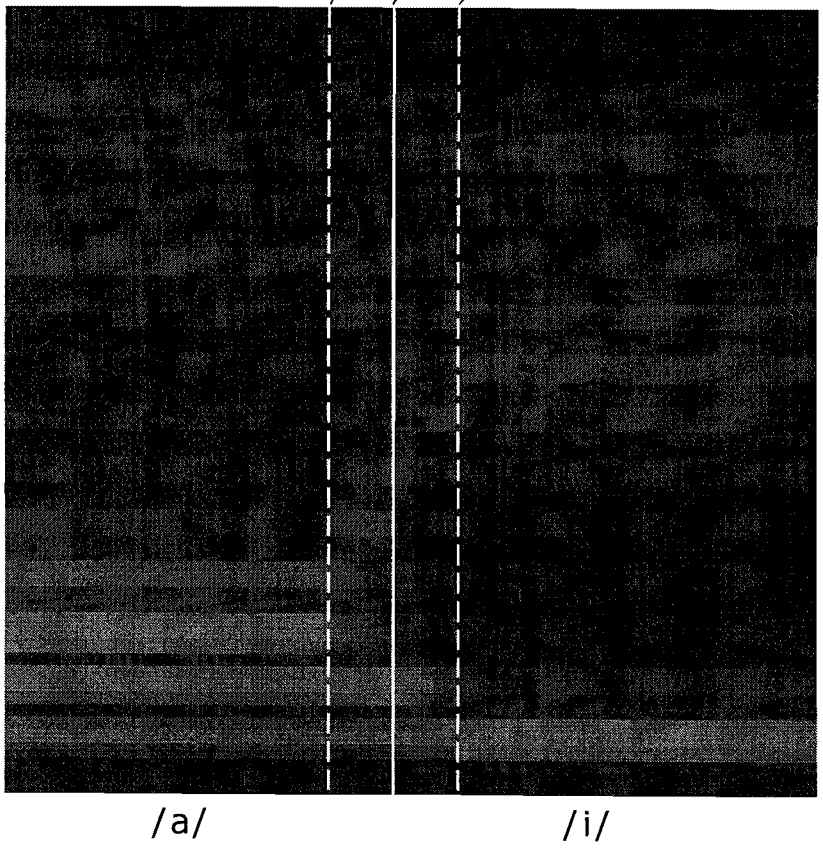
FIG. 14A is a graph showing a spectrum when PARCOR coefficients at a boundary between a vowel /a/ and a vowel /i/ are interpolated.

FIG. 14A is a graph showing a spectrum when PARCOR coefficients at a boundary between a vowel /a/ and a vowel /i/ are interpolated. FIG. 14B is a graph showing a spectrum when voices at the boundary between the vowel /a/ and the vowel /i/ are connected to each other by cross-fade. In each of FIGS. 14A and 14B, a vertical axis represents a frequency and a horizontal axis represents time. In FIG. 14A, when a boundary time at a vowel boundary 21 is assumed to be a time t, it is seen that a strong peak on the spectrum is continuously varied in a range from a time t−Δt (22) to a time t+Δt (23). On the other hand, in FIG. 14B, a peak on the spectrum is changed without continuity at a vowel boundary 24. As shown in these figures, interpolation of values of the PARCOR coefficients can continuously vary the spectrum peak (corresponding to formant). As a result, the continuous change of the formant allows a synthetic speech to have a continuous change from /a/ to /i/.

Figure 15:
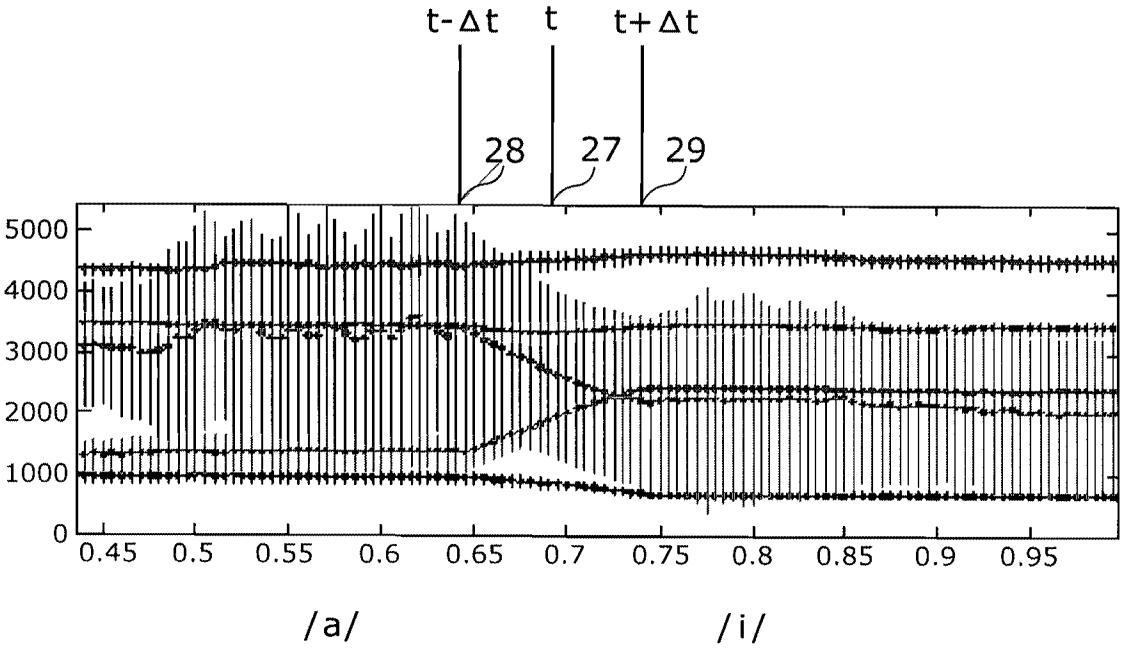
FIG. 15 is a graph plotting formants extracted from PARCOR coefficients generated by interpolating synthesized PARCOR coefficients

Moreover, FIG. 15 is a graph plotting formants extracted again from PARCOR coefficients generated by interpolating synthesized PARCOR coefficients. In FIG. 15, a vertical axis represents a frequency (Hz) and a horizontal axis represents time (sec). Points in FIG. 15 represent formant frequency of each frame of a synthetic speech. Each vertical bar added to points represents a strength of a formant. A shorter vertical bar shows a stronger formant strength, and a longer vertical bar shows a weaker formant strength. In this figure using formants, it is also seen that each formant (or each formant strength) is continuously varied in a glide section (section from a time 28 to a time 29) having a vowel boundary 27 as a center.

As described above, at the vowel boundary, the interpolation of PARCOR coefficients using an appropriate glide section allows formants and a spectrum to be continuously converted. As a result, natural phoneme transition can be achieved.

Such continuous transition of a spectrum and formants cannot be achieved by speech cross-fade as shown in FIG. 14B.

Figure 16:
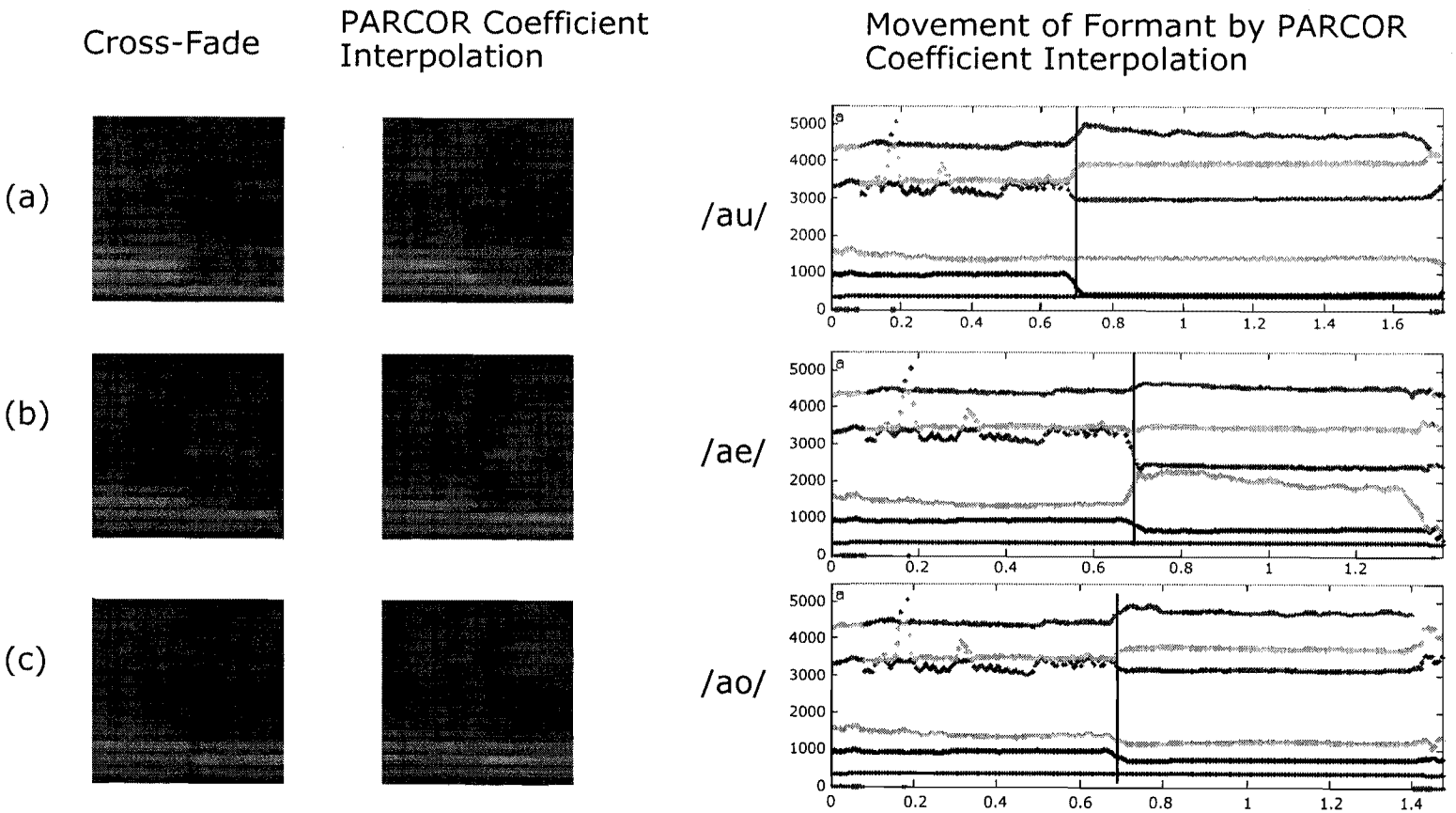
FIG. 16 shows spectrums of cross-fade connection, spectrums with PARCOR coefficient interpolation, and movement of formant caused by the PARCOR coefficient interpolation, in connection of /a/ and /u/ in FIG. 16 (*a*), in connection of /a/ and /e/ in FIG. 16 (*b*), and in connection of /a/ and /o/ in FIG. 16 (*c*).

Likewise, FIG. 16 shows a spectrum of cross-fade connection, a spectrum of PARCOR coefficient interpolation, and movements of formants caused by the PARCOR coefficient interpolation, for each of connection of /a/ and /u/ (FIG. 16 (*a*)), connection of /a/ and /e/ (FIG. 16 (*b*)), and connection of /a/ and /o/ (FIG. 16 (*c*)). As shown in the figures, a peak of a spectrum strength can be continuously varied in every vowel connection.

In short, it is proved that interpolation of vocal tract shapes (PARCOR coefficients) can result in interpolation of formants. Thereby, even in a synthetic speech, natural phoneme transition of vowels can be expressed.

Figure 17A:
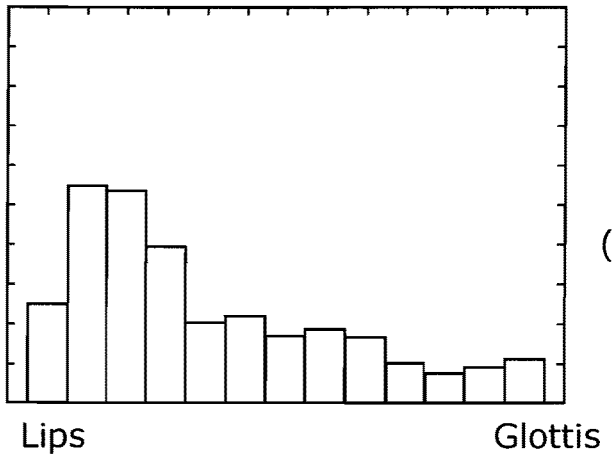
FIG. 17A is a graph showing vocal tract sectional areas of a male speaker uttering an original speech.
Figure 17B:
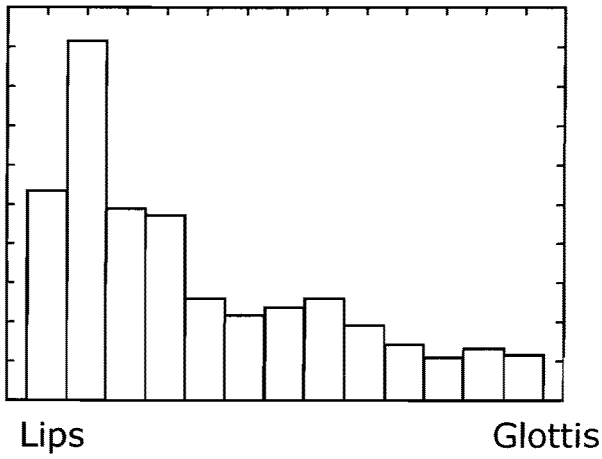
FIG. 17B is a graph showing vocal tract sectional areas of a female speaker uttering a target speech.
Figure 17C:
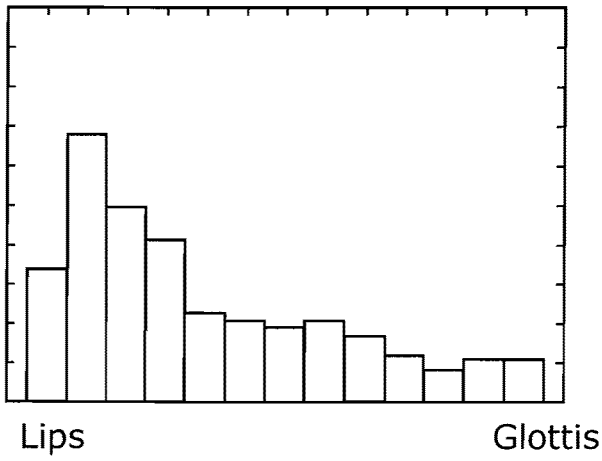
FIG. 17C is a graph showing vocal tract sectional areas corresponding to a PARCOR coefficient generated by converting a PARCOR coefficient of the original speech at a conversion ratio of 50%.

Each of FIGS. 17A to 17C is a graph showing vocal tract sectional areas regarding a temporal center of a converted vowel section. In these figures, a PARCOR coefficient at a temporal center point of the PARCOR coefficient shown in FIG. 12 is converted to vocal tract sectional areas using the equation 1. In each of FIGS. 17A to 17C, a horizontal axis represents a location of an acoustic tube and a vertical axis represents an vocal tract sectional area. FIG. 17A shows vocal tract sectional areas of a male speaker uttering an original speech, FIG. 17B shows vocal tract sectional areas of a female speaker uttering a target speech, and FIG. 17C shows vocal tract sectional areas corresponding to a PARCOR coefficient generated by converting a PARCOR coefficient of the original speech at a conversion ratio 50%. These figures also show that the vocal tract sectional areas shown in FIG. 17C are average between the original speech and the target speech.

<Consonant Vocal Tract Information Hold Unit 104>

It has been described that voice quality is converted to voice quality of a target speaker by converting vowels included in vocal tract information with phoneme boundary information to vowel vocal tract information of the target speaker using the vowel conversion unit 103. However, the vowel conversion results in discontinuity of pieces of vocal tract information at a connection boundary between a consonant and a vowel.

Figure 18:
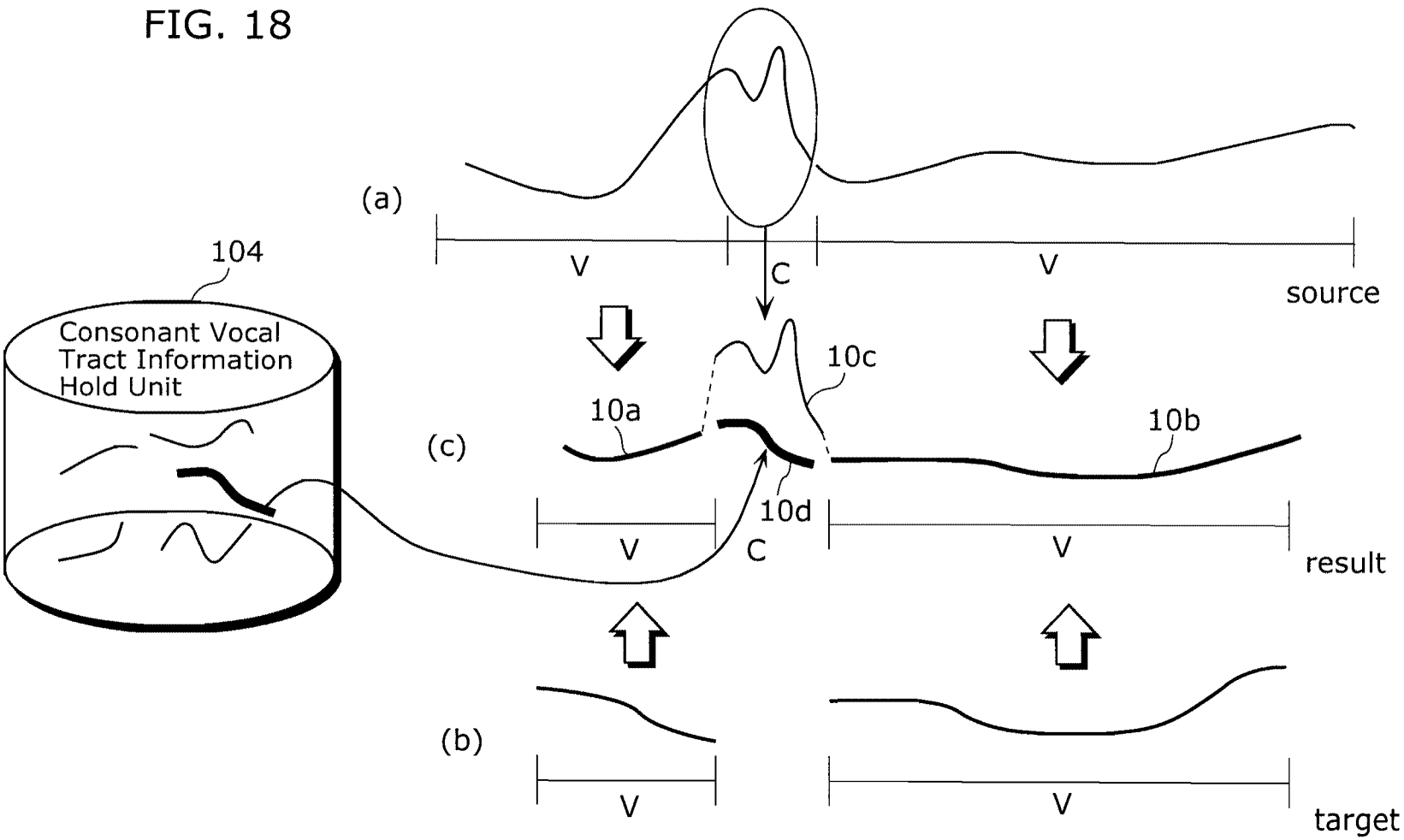
FIG. 18 is a diagram for explaining processing of selecting consonant vocal tract information by a consonant selection unit.

FIG. 18 is a diagram for explaining an example of PARCOR coefficients after vowel conversion of the vowel conversion unit 103 in a VCV (where V represents a vowel and C represents a consonant) phoneme sequence.

In FIG. 18, a horizontal axis represents a time axis, and a vertical axis represents a PARCOR coefficient. FIG. 18 (*a*) shows vocal tract information of voices of an input speech (in other words, source speech). PARCOR coefficients of vowel parts in the vocal tract information are converted by the vowel conversion unit 103 using vocal tract information of a target speaker as shown in FIG. 18 (*b*). As a result, pieces of vocal tract information 10*a* and 10*b* of the vowel parts as shown in FIG. 18 (*c*) are generated. However, a piece of vocal tract information 10*c* of a consonant is not converted and still shows a vocal tract shape of the input speech. This causes discontinuity at a boundary between the vocal tract information of the vowel parts and the vocal tract information of the consonant part. Therefore, the vocal tract information of the consonant part is also to be converted. A method of converting the vocal tract information of the consonant part is described below.

It is considered that individuality of a speech is expressed mainly by vowels in consideration of durations and stability of vowels and consonants.

Therefore, regarding consonants, vocal tract information of a target speaker is not used, but from predetermined plural pieces of vocal tract information of each consonant, vocal tract information of a consonant suitable for vocal tract information of vowels converted by the vowel conversion unit 103 is selected. As a result, the discontinuity at the connection boundary between the consonant and the converted vowels can be reduced. In FIG. 18 (*c*), from among plural pieces of vocal tract information of a consonant held in the consonant vocal tract information hold unit 104, vocal tract information 10*d* of the consonant which has a good connection to the vocal tract information 10*a* and 10*b* of vowels prior and subsequent to the consonant is selected to reduce the discontinuity at the phoneme boundaries.

In order to achieve the above processing, consonant sections are previously cut out from a plurality of utterances of a plurality of speakers, and pieces of consonant vocal tract information to be held in the consonant vocal tract information hold unit 104 are generated by calculating a PARCOR coefficient for each of the consonant sections in the same manner as the generation of target vowel vocal tract information held in the target vowel vocal tract information hold unit 101.

<Consonant Selection Unit 105>

From the consonant vocal tract information hold unit 104, the consonant selection unit 105 selects a piece of consonant vocal tract information suitable for vowel vocal tract information converted by the vowel conversion unit 103. Which consonant vocal tract information is to be selected is determined based on a kind of a consonant (phoneme) and continuity of pieces of vocal tract information at connection points of a beginning and an end of the consonant. In other words, it is possible to determined, based on continuity at connection points of PARCOR coefficients, which consonant vocal tract information is to be selected. More specifically, the consonant selection unit 105 searches for consonant vocal tract information $C_i$ satisfying the following equation 6.

[Formula 11]

$$C_i = \underset{C_K}{\operatorname{argmin}}[(w \times Cc(U_{i-1}, C_k) + (1-w)Cc(C_k, U_{i+1})] \quad \text{(Equation 6)}$$

where $U_{i-1}$ represents vocal tract information of a phoneme prior to a consonant to be selected and $U_{i+1}$ represents vocal tract information of a phoneme subsequent to the consonant to be selected.

Here, w represents a weight of (i) continuity between the prior phoneme and the consonant to be selected or a weight of (ii) continuity between the consonant to be selected and the subsequent phoneme. The weight w is appropriately set to emphasize the connection between the consonant to be selected and the subsequent phoneme. The connection between the consonant to be selected and the subsequent phoneme is emphasized because a consonant generally has a stronger connection to a vowel subsequent to the consonant than a vowel prior to the consonant.

A function Cc is a function representing a continuity between pieces of vocal tract information of two phonemes, for example, representing the continuity by an absolute value of a difference between PARCOR coefficients at a boundary between two phonemes. It should be noted that a lower-order PARCOR coefficient may have a more weight.

As described above, by selecting a piece of vocal tract information of a consonant suitable for pieces of vocal tract information of vowels which are converted to a target voice quality, smooth connection can be achieved to improve naturalness of a synthetic speech.

It should be noted that the consonant selection unit 105 may select vocal tract information for only voiced consonants and use received vocal tract information for unvoiced consonants. This is because unvoiced consonants are utterances without vibration of vocal cord and processes of generating unvoiced consonants are therefore different from processes of generating vowels and voiced consonants.

<Consonant Transformation Unit 106>

It has been described that the consonant selection unit 105 can obtain consonant vocal tract information suitable for vowel vocal tract information converted by the vowel conversion unit 103. However, continuity at a connection point of the pieces of information is not always sufficient. Therefore, the consonant transformation unit 106 transforms the consonant vocal tract information selected by the consonant selection unit 105 to be continuously connected to a vowel subsequent to the consonant at is the connection point.

In more detail, the consonant transformation unit 106 shifts a PARCOR coefficient of the consonant at the connection point connected to the subsequent vowel so that the PARCOR coefficient matches a PARCOR coefficient of the subsequent vowel. Here, the PARCOR coefficient needs to be within a range [−1, 1] for assurance of stability. Therefore, the PARCOR coefficient is mapped on a space of [−∞, ∞] applying a function of $\tan h^{-1}$, for example, and then shifted to be linear on the mapped space. Then, the resulting PARCOR coefficient is set again within the range of [−1, 1] applying a function of tan h. As a result, while assuring stability, continuity between a vocal tract shape of a section of the consonant and a vocal tract shape of a section of the subsequent vowel can be improved.

<Synthesis Unit 107>

The synthesis unit 107 synthesizes a speech using vocal tract information for which voice quality has been converted and sound source information which is separately received. A method of the synthesis is not limited, but when PARCOR coefficients are used as pieces of vocal tract information, PARCOR synthesis can be used. It is also possible that a speech is synthesized after converting PARCOR coefficients to LPC coefficients, or that a speech is synthesized by extracting formants from PARCOR coefficients and using formant synthesis. It is further possible that a speech is synthesized by calculating LSP coefficients from PARCOR coefficients and using LSP synthesis.

Next, the processing performed in the first embodiment is described with reference to flowcharts of FIGS. 19A and 19B.

The processing performed in the first embodiment is broadly divided into two kinds of processing. One of them is processing of building the target vowel vocal tract information hold unit 101, and the other is processing of converting voice quality.

Figure 19A:
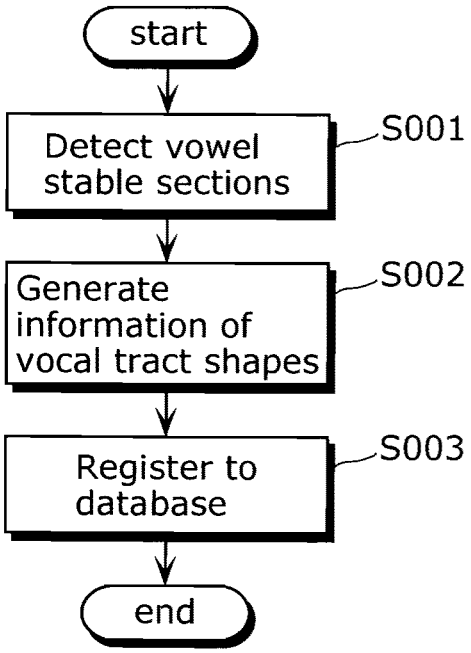
FIG. 19A is a flowchart of processing of building a target vowel vocal tract information hold unit.

Firstly, with reference to FIG. 19A, the processing of building the target vowel vocal tract information hold unit 101 is described.

From a speech uttered by a target speaker, stable sections of vowels are extracted (Step S001). For a method of extracting the stable sections, as described previously, the phoneme recognition unit 202 recognizes phonemes, and from among the vowel sections in the recognition results the vowel stable section extraction unit 203 extracts, as vowel stable sections, vowel sections each having a likelihood equal to or greater than a threshold value The target vocal tract information generation unit 204 generates vocal tract information for each of the extracted vowel section (Step S002). As described previously, the vocal tract information can be expressed by a PARCOR coefficient. The PARCOR coefficient can be calculated from a polynomial expression of an all-pole model. Therefore, LPC analysis or ARX analysis can be used as an analysis method.

As pieces of the vocal tract information, the target vocal tract information generation unit 204 registers the PARCOR coefficients of the vowel stable sections which are analyzed at Step S002 to the target vowel vocal tract information hold unit 101 (Step S003).

By the above processing, it is possible to build the target vowel vocal tract information hold unit 101 characterizing voice quality of the target speaker.

Figure 19B:
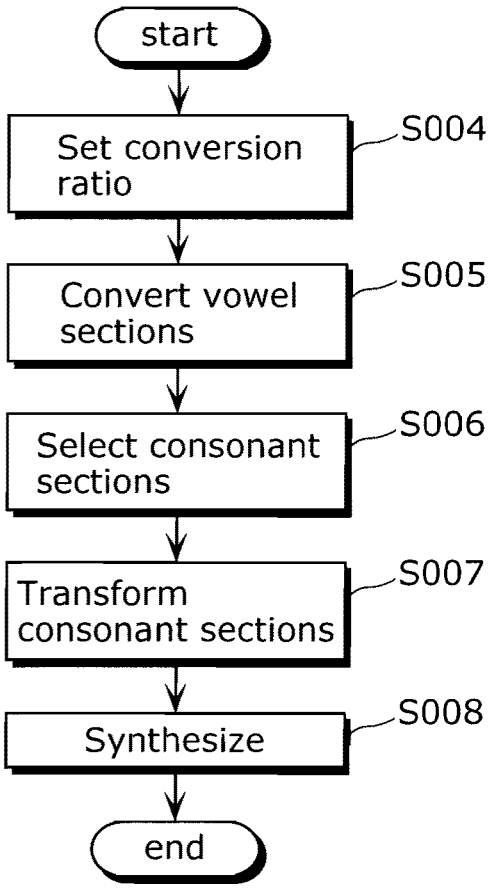
FIG. 19B is a flowchart of processing of converting a received speech with phoneme boundary information into a speech of a target speaker.

Next, with reference to FIG. 19B, the processing of converting an input speech with phoneme boundary information to a speech of the target speaker using the voice quality conversion device shown in FIG. 3.

The conversion ratio receiving unit 102 receives a conversion ratio representing a degree of conversion to voice quality of the target speaker (Step S004).

For each vowel section in the input speech, the vowel conversion unit 103 obtains target vocal tract information of the corresponding vowel from the target vowel vocal tract information holding unit 101, and converts pieces of the vocal tract information of the vowel sections in the input speech based on the conversion ratio received at Step S004.

For each consonant, the consonant selection unit 105 selects a piece of consonant vocal tract information suitable for the converted vocal tract information of the vowel sections (Step S006). Here, with reference to (i) a kind of the corresponding consonant (phoneme) and (ii) continuity of pieces of vocal tract information at connection points between (ii−1) the consonant and (ii−2) phonemes prior and subsequent to the consonant, the consonant selection unit 105 selects the consonant vocal tract information having the highest continuity.

The consonant transformation unit 106 transforms the selected consonant vocal tract information to increase the continuity between the selected consonant vocal tract information and the pieces of vowel vocal tract information of phonemes prior and subsequent to the consonant. The transformation is achieved by shifting a PARCOR coefficient of the consonant based on a difference between pieces of vocal tract information (PARCOR coefficients) at (i) a connection point of between the selected consonant vocal tract information and the vowel vocal tract information of the phoneme prior to the consonant and (ii) a connection point between the selected consonant vocal tract information and the vowel vocal tract information of the phoneme subsequent to the consonant. In the above shifting, in order to assure stability of the PARCOR coefficient, the PARCOR coefficient is mapped on a space of $[-\infty, \infty]$ applying a function such as a $\tan h^{-1}$ function, and then shifted to be linear on the mapped space. Then, the resulting PARCOR coefficient is set again within the range of $[-1, 1]$ applying a function such as a tan h function. As a result, stable transformation of the consonant vocal tract information can be performed. It should be noted that the mapping from $[-1, 1]$ to $[-\infty, \infty]$ is not limited to be performed applying the $\tan h^{-1}$ function, but may be performed applying a function such as $f(x)=\mathrm{sgn}(x)\times 1/(1-|x|)$. Here, sgn(x) is a function that has a value of +1 when x is positive and a value of −1 when x is negative.

The above-described transformation of vocal tract information of a consonant section can generate vocal tract information of a corresponding consonant section which matches converted vocal tract information of vowel sections and has a high continuity with the converted vocal tract information. As a result, stable and continuous voice quality conversion with high quality sound can be achieved.

The synthesis unit 107 generates a synthetic speech based on the pieces of vocal tract information converted by the vowel conversion unit 103, the consonant selection unit 105, and the consonant transformation unit 106 (Step S008). Here, sound source information of the original speech (the input speech) can be used as sound source information for the synthetic speech. In general, LPC analytic-synthesis often uses an impulse sequence as an excitation sound source. Therefore, it is also possible to generate a synthetic speech after transforming sound source information (fundamental frequency (F0), power, and the like) based on predetermined information such as a fundamental frequency. Thereby, it is possible to convert not only feigned voices represented by vocal tract information, but also (i) prosody represented by a fundamental frequency or (ii) sound source information.

It should be noted that the synthesis unit 107 may use glottis source models such as Rosenberg-Klatt model. With such a structure, it is also possible to use a method using a value generated by shifting a parameter (OQ, TL, AV, F0, or the like) of the Rosenberg-Klatt model from an original speech to a target speech.

With the above structure, in receiving speech information with phoneme boundary information, the vowel conversion unit 103 converts (i) vocal tract information of each vowel section included in the received vocal tract information with phoneme boundary information to (ii) vocal tract information held in the target vowel vocal tract information hold unit 101 and corresponding to the vowel section, based on a conversion ratio provided from the conversion ratio receiving unit 102. From the consonant vocal tract information hold unit 104, the consonant selection unit 105 selects, for each consonant, a consonant vocal tract information suitable for pieces of the vowel vocal tract information converted by the vowel conversion unit 103 based on pieces of vocal tract information of vowels prior and subsequent to the corresponding consonant. The consonant transformation unit 106 transforms the consonant vocal tract information selected by the consonant selection unit 105 depending on the pieces of vocal tract information of the vowels prior and subsequent to the consonant. The synthesis unit 107 synthesizes a speech based on the resulting vocal tract information with phoneme boundary information converted by the vowel conversion unit 103, the consonant selection unit 105, and the consonant transformation unit 106. Therefore, all that is necessary as vocal tract information of a target speaker is vocal tract information of each vowel stable section only. Moreover, since the generation of the vocal tract information of the target speaker needs recognition of only the vowel stable sections, the influence of speech recognition errors caused in Patent Reference 2 does not occur.

As a result, a load on a target speaker can be reduced, which results in easiness of the voice quality conversion. In the technology of Patent Reference 2, a conversion function is generated using a difference between (i) a speech element to be used in speech synthesis of the speech synthesis unit 14 and (ii) an utterance of a target speaker. Therefore, voice quality of an original speech to be converted needs to be identical or similar to voice quality of speech elements held in the speech synthesis data storage unit 13. On the other hand, the voice quality conversion device according to the present invention uses vowel vocal tract information of a target speaker as an absolute target. Therefore, voice quality of an original speech is not restricted at all and speeches having any voice quality can be inputted. In other words, restriction on input original speech is extremely low, which makes it possible to convert voice quality for various speeches.

Furthermore, the consonant selection unit 105 selects consonant vocal tract information from among pieces of consonant vocal tract information that have previously been stored in the consonant vocal tract information hold unit 104. As a result, it is possible to use optimum consonant vocal tract information suitable for converted vocal tract information of vowels.

It should be noted that it has been described in the first embodiment that sound source information is converted by the consonant selection unit 105 and the consonant transformation unit 106 not only for vowel sections but also for consonant sections, but the conversion for the consonant sections can be omitted. In this case, the pieces of vocal tract information of consonants included in the vocal tract information with phoneme boundary information provided to the voice quality conversion device are directly used in a synthetic speech without being converted. Thereby, even with low processing performance of a processing terminal or a small storage capacity, the voice quality conversion to a target speaker can be achieved.

It should be noted that only the consonant transformation unit 106 may be eliminated from the voice quality conversion device. In this case, the consonant vocal tract information selected by the consonant selection unit 105 are directly used in a synthetic speech.

It should also be noted that only the consonant selection unit 105 may be eliminated from the voice quality conversion device. In this case, the consonant transformation unit 106 directly transforms the consonant vocal tract information included in the vocal tract information with phoneme boundary information provided to the voice quality conversion device.

(Second Embodiment)

The following describes a second embodiment of the present invention.

The second embodiment differs from the voice quality conversion device of the first embodiment in that an original speech to be converted and target voice quality information are separately managed in different units. The original speech is considered as an audio content. For example, the original speech is a singing speech. It is assumed that various kinds of voice quality have previously stored as pieces of the target voice quality information. For example, pieces of voice quality information of various singers are assumed to be held. Under the assumption, a considered application of the first embodiment is that the audio content and the target voice quality information are separately downloaded from different locations and a terminal performs voice quality conversion.

Figure 20:
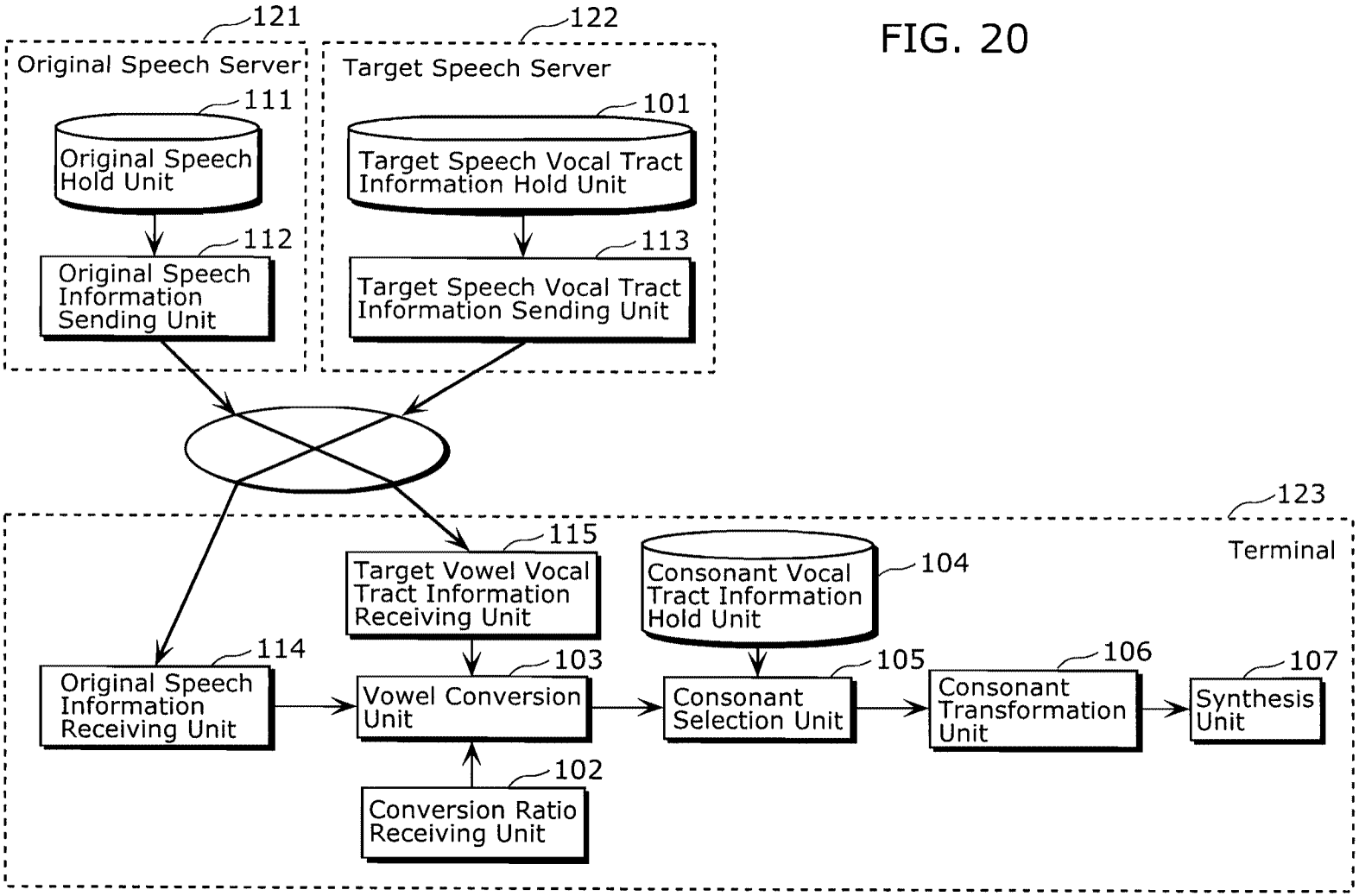
FIG. 20 is a diagram showing a structure of a voice quality conversion system according to a second embodiment of the present invention.

FIG. 20 is a diagram showing a configuration of a voice quality conversion system according to the second embodiment. In FIG. 20, the same reference numerals of FIG. 3 are assigned to the identical units of FIG. 20, so that the identical units are not explained again below.

The voice quality conversion system includes an original speech server 121, a target speech server 122, and a terminal 123.

The original speech server 121 is a server that manages and provides pieces of information regarding original speeches to be converted. The original speech server 121 includes an original speech hold unit 111 and an original speech information sending unit 112.

The original speech hold unit 111 is a storage device in which pieces of information regarding original speeches are held. Examples of the original speech hold unit 111 are a hard disk, a memory, and the like.

The original speech information sending unit 112 is a processing unit that sends the original speech information held in the original speech hold unit 111 to the terminal 123 via a network.

The target speech server 122 is a server that manages and provides pieces of information regarding various kinds of target voice quality. The target speech server 122 includes a target vowel vocal tract information hold unit 101 and a target vowel vocal tract information sending unit 113.

The target vowel vocal tract information sending unit 113 is a processing unit that sends vowel vocal tract information of a target speaker held in the target vowel vocal tract information hold unit 101 to the terminal 123 via a network.

The terminal 123 is a terminal device that converts voice quality of the original speech information received from the original speech server 121 based on the target vowel vocal tract information received from the target speech server 122. The terminal 123 includes an original speech information receiving unit 114, a target vowel vocal tract information receiving unit 115, the conversion ratio receiving unit 102, the vowel conversion unit 103, the consonant vocal tract information hold unit 104, the consonant selection unit 105, the consonant transformation unit 106, and the synthesis unit 107.

The original speech information receiving unit 114 is a processing unit that receives original speech information from the original speech information sending unit 112 via the network.

The target vowel vocal tract information receiving unit 115 is a processing unit that receives the target vowel vocal tract information from the target vowel vocal tract information sending unit 113 via the network.

Each of the original speech server 121, the target speech server 122, and the terminal 123 is implemented as a computer having a CPU, a memory, a communication interface, and the like. Each of the above-described processing units is implemented by executing a program by a CPU of a computer.

The second embodiment differs from the first embodiment in that each of (i) the target vowel vocal tract information which is vocal tract information of vowels regarding a target speaker and (ii) the original speech information which is information regarding an original speech is sent and received via a network.

Figure 21:
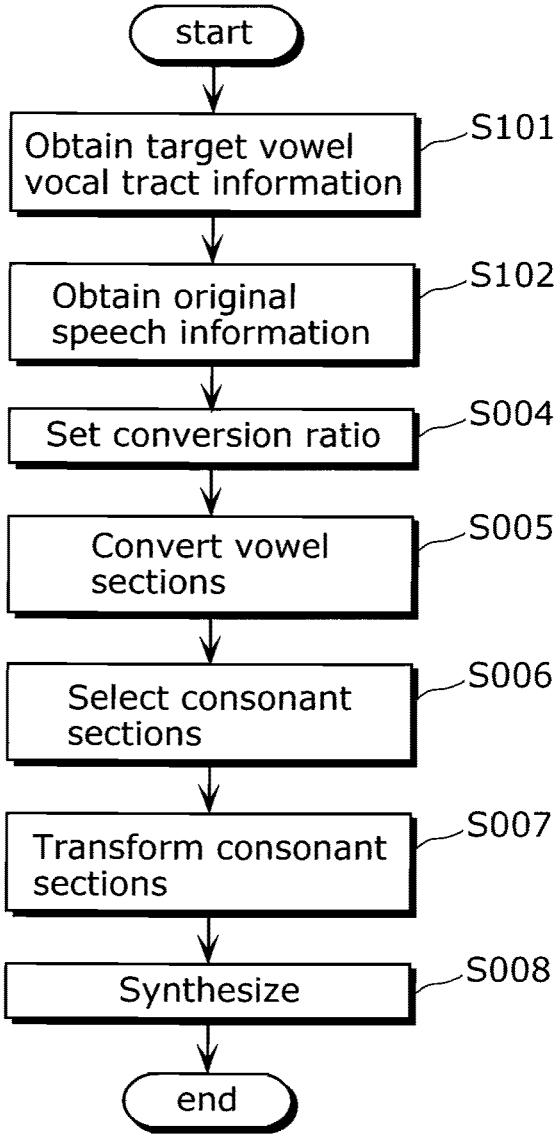
FIG. 21 is a flowchart of processing performed by the voice quality conversion system according to the second embodiment of the present invention.

Next, the processing performed by the voice quality conversion system according to the second embodiment is described. FIG. 21 is a flowchart of the processing performed by the voice quality conversion system according to the second embodiment of the present invention.

Via a network, the terminal 123 requests the target speech server 122 for vowel vocal tract information of a target speaker. The target vowel vocal tract information sending unit 113 in the target speech server 122 obtains the requested vowel vocal tract information of the target speaker from the target vowel vocal tract information hold unit 101, and sends the obtained information to the terminal 123. The target vowel vocal tract information receiving unit 115 in the terminal 123 receives the vowel vocal tract information of the target speaker (Step S101).

A method of designating a target speaker is not limited. For example, a speaker identifier may be used for the designation.

Via a network, the terminal 123 requests the original speech server 121 for original speech information. The original speech information sending unit 112 in the original speech server 121 obtains the requested original speech information from the original speech hold unit 111, and sends the obtained information to the terminal 123. The original speech information receiving unit 114 in the terminal 123 receives the original speech information (Step S102).

A method of designating original speech information is not limited. For example, it is possible that audio contents are managed using respective identifiers and the identifiers are used for the designation.

The conversion ratio receiving unit 102 receives a conversion ratio representing a degree of conversion to the target speaker (Step S004). It is also possible that a conversion ratio is not received but is set to a predetermined ratio.

For each vowel section in the original speech, the vowel conversion unit 103 obtains a piece of vocal tract information corresponding to the vowel section from the target vowel vocal tract information holding unit 101, and converts the obtained pieces of vocal tract information based on the conversion ratio received at Step S004 (Step S005).

The consonant selection unit 105 selects consonant vocal tract information suitable for converted vocal tract information of vowel sections (Step S006). Here, the consonant selection unit 105 selects, for each consonant, a piece of consonant vocal tract information having the highest continuity with reference to continuity of pieces of vocal tract information at connection points between the consonant and phonemes prior and subsequent to the consonant.

The consonant transformation unit 106 transforms the selected consonant vocal tract information to increase the continuity between the selected consonant vocal tract information and the pieces of vocal tract information of phonemes prior and subsequent to the consonant (Step S007). The transformation is achieved by shifting a PARCOR coefficient of the consonant based on a difference value between pieces of vocal tract information (PARCOR coefficients) at (i) a connection point of between the selected consonant vocal tract information and the vowel vocal tract information of the phoneme prior to the consonant and (ii) a connection point between the selected consonant vocal tract information and the vowel vocal tract information of the phoneme subsequent to the consonant. In the above shifting, in order to assure stability of the PARCOR coefficient, the PARCOR coefficient is mapped on a space of $[-\infty, \infty]$ applying a function such as a $\tan h^{-1}$ function, and then shifted to be linear on the mapped space. Then, the resulting PARCOR coefficient is set again within the range of $[-1, 1]$ applying a function such as a tan h function. As a result, more stable transformation of the consonant vocal tract information can be performed. It should be noted that the mapping from $[-1, 1]$ to $[-\infty, \infty]$ is not limited to be performed applying the $\tan h^{-1}$ function, but may be performed applying a function such as $f(x)=\mathrm{sgn}(x)\times 1/(1-|x|)$. Here, sgn(x) is a function that has a value of +1 when x is positive and a value of −1 when x is negative.

The above-described transformation of vocal tract information of a consonant section can generate vocal tract information of a corresponding consonant section which matches converted vocal tract information of vowel sections and has a high continuity with the converted vocal tract information. As a result, stable and continuous voice conversion with high quality sound can be achieved.

The synthesis unit 107 generates a synthetic speech based on the pieces of vocal tract information converted by the vowel conversion unit 103, the consonant selection unit 105, and the consonant transformation unit 106 (Step S008). Here, sound source information of the original speech can be used as sound source information for the synthetic speech. It is also possible to generate a synthetic speech after transforming sound source information based on predetermined information such as a fundamental frequency. Thereby, it is possible to convert not only feigned voices represented by vocal tract information, but also prosody represented by a fundamental frequency or sound source information.

It should be noted that the order of performing the Steps S101, S102, and S004 is not limited to the above and may be any desired order.

With the above structure, the target speech server 122 manages and sends target speech information. Thereby, the terminal 123 does not need to generate the target speech information and is thereby capable of performing voice quality conversion to various kinds of voice quality registered in the target speech server 122.

In addition, since the original speech server 121 manages and sends an original speech to be converted, the terminal 123 does not need to generate information of the original speech and is thereby capable of using various pieces of original speech information registered in the original speech server 121.

When the original speech server 121 manages audio contents and the target speech server 122 manages pieces of voice quality information of target speakers, it is possible to manage the audio contents and the voice quality information of speakers separately. Thereby, a user of the terminal 123 can listen to an audio content which the user likes by voice quality which the user likes.

For example, when the original speech server 121 manages singing sounds and the target speech server 122 manages pieces of target speech information of various singers, the terminal 123 allows the user to convert various pieces of music to voice quality of various singers to be listened, providing the user with music according to preference of the user.

It should be noted that both of the original speech server 121 and the target speech server 122 may be implemented in the same server.

(Third Embodiment)

In the second embodiment, the application has been described that a server manages original speech and target vowel vocal tract information and a terminal downloads them and generates a speech with converted voice quality. In the third embodiment, on the other hand, an application is described that a user registers his/her own voice quality using a terminal and converts a song ringtone for alerting an incoming call or message to have the user's voice quality to enjoy it.

Figure 22:
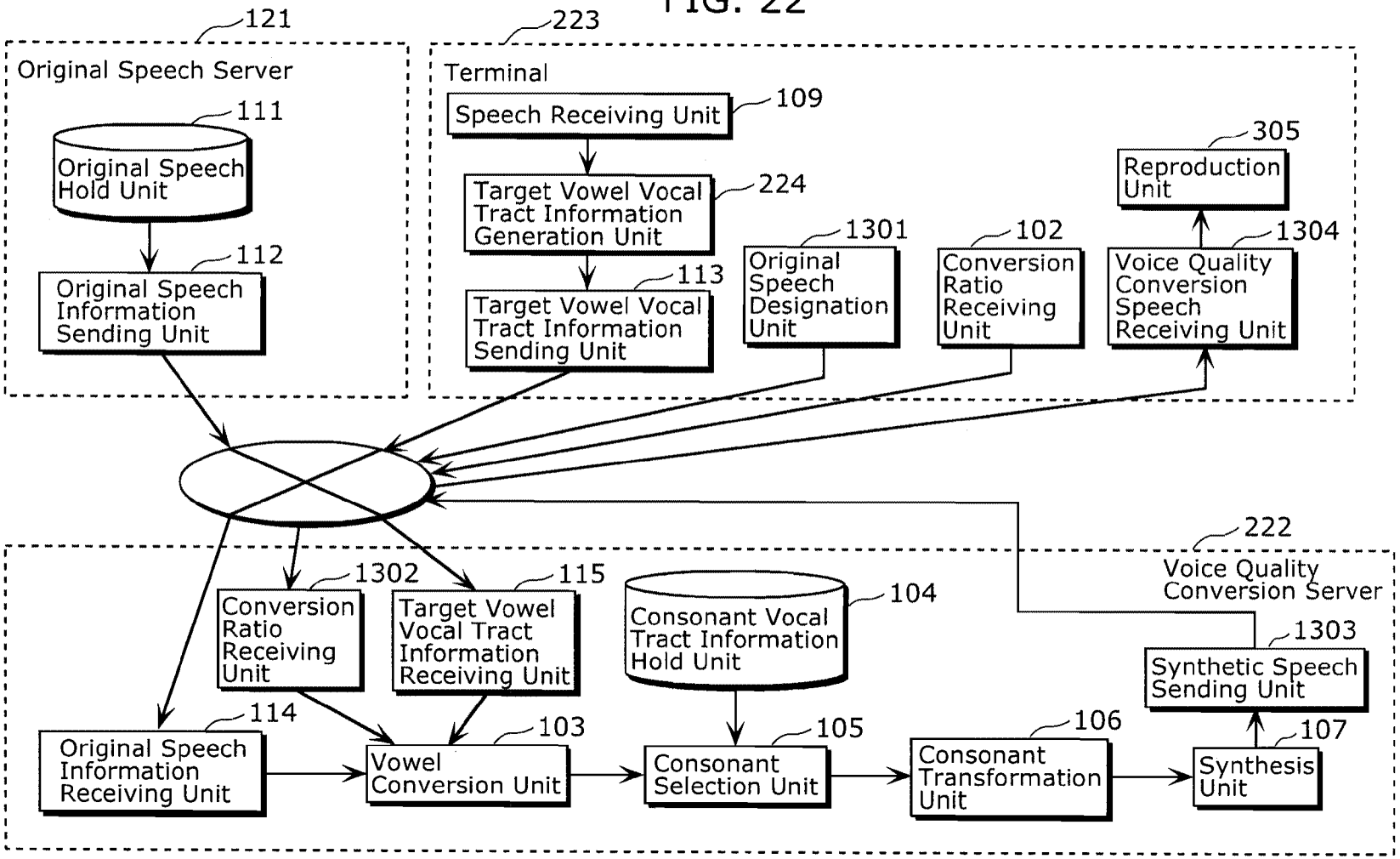
FIG. 22 is a diagram showing a configuration of a voice quality conversion system according to a third embodiment of the present invention.

FIG. 22 is a diagram showing a structure of a voice quality conversion system according to the third embodiment of the present invention. In FIG. 22, the same reference numerals of FIG. 3 are assigned to the identical units of FIG. 22, so that the identical units are not explained again below.

The voice quality conversion system includes a original speech server 121, a target speech server 222, and a terminal 223.

The original speech server 121 basically has the same structure as that of the original speech server 121 described in the second embodiment, including the original speech hold unit 111 and the original speech information sending unit 112. However, a destination of original speech information sent from the original speech information sending unit 112 of the third embodiment is different from that of the second embodiment. The original speech information sending unit 112 according to the third embodiment sends original speech information to the voice quality conversion server 222 via a network.

The terminal 223 is a terminal device by which a user enjoys singing voice conversion services. More specifically, the terminal 223 is a device that generates target voice quality information, provides the generated information to the voice quality conversion server 222, and also receives and reproduces singing voice converted by the voice quality conversion server 222. The terminal 223 includes a speech receiving unit 109, a target vowel vocal tract information generation unit 224, a target vowel vocal tract information sending unit 113, an original speech designation unit 1301, a conversion ratio receiving unit 102, a voice quality conversion speech receiving unit 1304, and a reproduction unit 305. The speech receiving unit 109 is a device that receives voice of the user. An example of the speech receiving unit 109 is a microphone.

The target vowel vocal tract information generation unit 224 is a processing unit that generates target vowel vocal tract information which is vocal tract information of a vowel of a target speaker who is the user inputting the voice to the speech receiving unit 109. A method of the generation of the target vowel vocal tract information is not limited. For example, the target vowel vocal tract information generation unit 224 may generate the target vowel vocal tract information using the method shown in FIG. 5 and have the vowel stable section extraction unit 203 and the target vocal tract information generation unit 204.

The target vowel vocal tract information sending unit 113 is a processing unit that sends the target vowel vocal tract information generated by the target vowel vocal tract information generation unit 224 to the voice quality conversion server 222 via a network.

The original speech designation unit 1301 is a processing unit that designates original speech information to be converted from among pieces of original speech information held in the original speech server 121 and sends the designated information to the voice quality conversion server 222 via a network.

The conversion ratio receiving unit 102 of the third embodiment basically has the same structure of that of the conversion ratio receiving unit 102 of the first and second embodiments. However, the conversion ratio receiving unit 102 of the third embodiment differs from the conversion ratio receiving unit 102 of the first and second embodiments in further sending the received conversion ratio to the voice quality conversion server 222 via a network. It is also possible that the conversion ratio is not received but is set to a predetermined ratio.

The voice quality conversion speech receiving unit 1304 is a processing unit that receives a synthetic speech that is original speech with voice quality converted by the voice quality conversion server 222.

The reproduction unit 306 is a device that reproduces a synthetic speech received by the voice quality conversion speech receiving unit 1304. An example of the reproduction unit 306 is a speaker.

The voice quality conversion server 222 is a device that converts voice quality of the original speech information received from the original speech server 121 based on the target vowel vocal tract information received from the target vowel vocal tract information sending unit 113 in the terminal 223. The voice quality conversion server 222 includes an original speech information receiving unit 114, a target vowel vocal tract information receiving unit 115, a conversion ratio receiving unit 1302, a vowel conversion unit 103, a consonant speech information hold unit 104, a consonant selection unit 105, a consonant transformation unit 106, a synthesis unit 107, and a synthetic speech sending unit 1303.

The conversion ratio receiving unit 1302 is a processing unit that receives a conversion ratio from the conversion ratio receiving unit 102.

The synthetic speech sending unit 1303 is a processing unit that sends the synthetic speech provided from the synthesis unit 107, to the voice quality conversion speech receiving unit 1304 in the terminal 223 via a network.

Each of the original speech server 121, the voice quality conversion server 222, and the terminal 223 is implemented as a computer having a CPU, a memory, a communication interface, and the like. Each of the above-described processing units is implemented by executing a program by a CPU of a computer.

The third embodiment differs from the second embodiment in that the terminal 223 extracts target voice quality features and then sends the extracted features to the voice quality conversion server 222 and the voice quality conversion server 222 sends a synthetic speech with converted voice quality back to the terminal 223, thereby generating the synthetic speech having the voice quality features extracted by the terminal 223.

Figure 23:
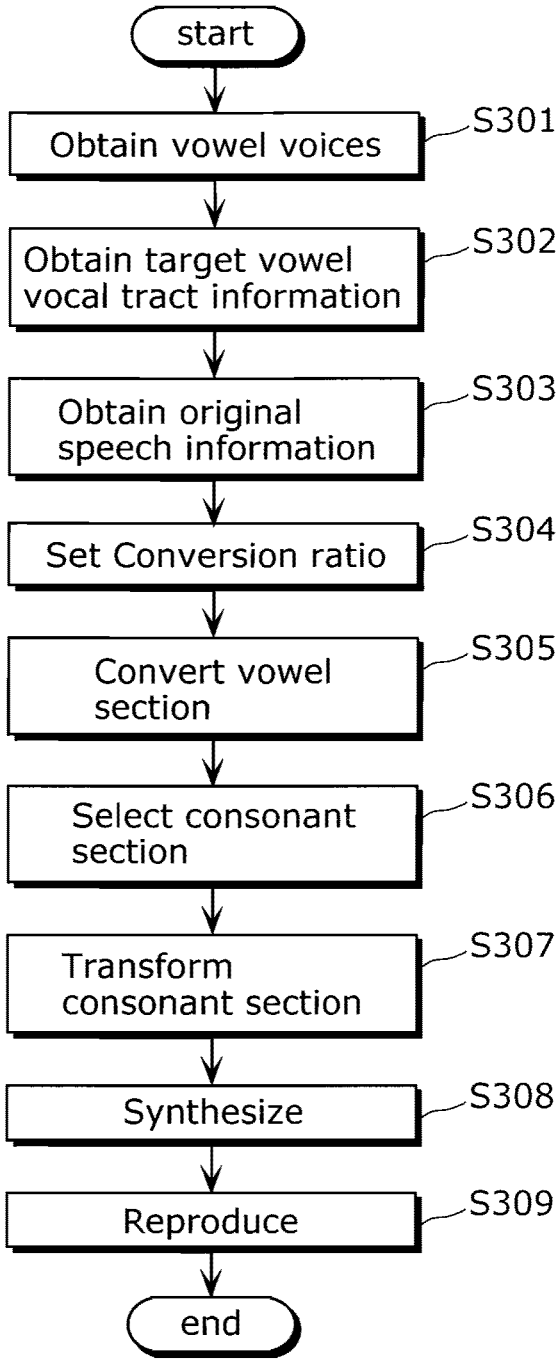
FIG. 23 is a flowchart of processing performed by the voice quality conversion system according to the third embodiment of the present invention.

Next, the processing performed by the voice quality conversion system according to the third embodiment is described. FIG. 23 is a flowchart of the processing performed by the voice quality conversion system according to the third embodiment of the present invention.

The terminal 223 obtains vowel voices of the user using the speech receiving unit 109. For example, the vowel voices can be obtained when the user utters "a, i, u, e, o" to a microphone. A method of obtaining vowel voices is not limited to the above, and vowel voices may be extracted from a text uttered as shown in FIG. 6 (Step S301).

The terminal 223 generates pieces of vocal tract information from the vowel voices obtained using the target vowel vocal tract information generation unit 224. A method of generating the vocal tract information may be the same as the method described in the first embodiment (Step S302).

The terminal 223 designates original speech information using the original speech designation unit 1301. A method of the designation is not limited. The original speech information sending unit 112 in the original speech server 121 selects the original speech information designated by the original speech designation unit 1301 from among pieces of original speech information held in the original speech hold unit 111, and sends the selected information to the voice quality conversion server 222 (Step S303).

The terminal 223 obtains a conversion ratio using the conversion ratio receiving unit 102 (Step S304).

The conversion ratio receiving unit 1302 in the voice quality conversion server 222 receives the conversion ratio from the terminal 223, and the target vowel vocal tract information receiving unit 115 receives target vowel vocal tract information from the terminal 223. The original speech information receiving unit 114 receives the original speech information from the original speech server 121. Then, for vocal tract information of each vowel section in the received original speech information, the vowel conversion unit 103 obtains target vowel vocal tract information of the corresponding vowel section from the target vowel vocal tract information sending unit 115, and converts the obtained vowel vocal tract information based on the conversion ratio received from conversion ratio receiving unit 1302 (Step S305).

The consonant selection unit 105 in the voice quality conversion server 222 selects consonant vocal tract information suitable for the converted vowel vocal tract information of vowel sections (Step S306). Here, the consonant selection unit 105 selects, for each consonant, a piece of consonant vocal tract information having the highest continuity with reference to continuity of pieces of vocal tract information at connection points between the consonant and phonemes prior and subsequent to the consonant.

The consonant transformation unit 106 in the voice quality conversion server 222 transforms the selected consonant vocal tract information to increase the continuity between the selected consonant vocal tract information and the pieces of vowel vocal tract information of phonemes prior and subsequent to the consonant (Step S307).

The method of the transformation may be the same as the method described in the second embodiment. The above-described transformation of vocal tract information of a consonant section can generate vocal tract information of a corresponding consonant section which matches converted vocal tract information of vowel sections and has a high continuity with the converted vocal tract information. As a result, stable and continuous voice quality conversion with high quality sound can be achieved.

The synthesis unit 107 in the voice quality conversion server 222 generates a synthetic speech based on the pieces of vocal tract information converted by the vowel conversion unit 103, the consonant selection unit 105, and the consonant transformation unit 106, and the synthetic speech sending unit 1303 sends the generated synthetic speech to the terminal 223 (Step S308). Here, sound source information of the original speech can be used as sound source information to be used in the synthetic speech generation. It is also possible to generate a synthetic speech after transforming sound source information based on predetermined information such as a fundamental frequency. Thereby, it is possible to convert not only feigned voices represented by vocal tract information, but also (i) prosody represented by a fundamental frequency or (ii) sound source information.

The voice quality conversion speech receiving unit 1304 in the terminal 223 receives the synthetic speech from the synthetic speech sending unit 1303, and the reproduction unit 305 reproduces the received synthetic speech (S309).

With the above structure, the terminal 223 generates and sends target speech information, and receives and reproduces the speech with voice quality converted by the voice quality conversion server 222. As a result, the terminal 223 receives a target speech and generates vocal tract information of only target vowels, which significantly reduces a processing load on the terminal 223.

In addition, the original speech server 121 manages original speech information and sends the original speech information to the voice quality conversion server 222. Therefore, the terminal 223 does not need to generate the original speech information.

The original speech server 121 manages audio contents and the terminal 223 generates only target voice quality. Therefore, a user of the terminal 123 can listen to an audio content which the user likes by voice quality which the user likes.

For example, the original speech server 121 manages singing sounds and a singing sound is converted by the voice quality conversion server 222 to have target voice quality obtained by the terminal 223, which makes it possible to provide the user with music according to preference of the user.

It should be noted that both of the original speech server 121 and the voice quality conversion server 222 may be implemented in the same server.

For another application of the third embodiment, if the terminal 223 is a mobile telephone, a user can register an obtained synthetic speech as a ringtone, for example, thereby generating his/her own ringtone.

In addition, in the structure of the third embodiment, the voice quality conversion is performed by the voice quality conversion server 222, so that the voice quality conversion can be managed by the server. Thereby, it is also possible to manage a history of voice conversion of a user. As a result, a problem of infringement of copyright and portrait right is unlikely to occur.

It should be noted that it has been described in the third embodiment that the target vowel vocal tract information generation unit 224 is included in the terminal 223, but the target vowel vocal tract information generation unit 224 may be included in the voice quality conversion server 222. In such a structure, target vowel speech received by the speech receiving unit 109 is sent to the voice quality conversion server 222 via a network. It should also be note that the voice quality conversion server 222 may generate target vowel vocal tract information by the target vowel vocal tract information generation unit 224 from the received speech and use the generated information in voice quality conversion of the vowel conversion unit 103. With the above structure, the terminal 223 needs to receive only vowels of target voice quality, which provides advantages of a quite small amount of processing load.

It should be noted that applications of the third embodiment is not limited to the voice quality conversion of singing voice ringtone of a mobile telephone. For example, a song by a singer is reproduced with voice quality of a user, so that a song having the professional singing skill and the user's voice quality can be listened. The user can practice the professional singing skill by singing to copy the reproduced song. Therefore, the third embodiment can be applied to Karaoke practice.

The above-described embodiments are merely examples for all aspects and do not limit the present invention. A scope of the present invention is recited by claims not by the above description, and all modifications are intended to be included within the scope of the present invention with meanings equivalent to the claims and without departing from the claims.

Industrial Applicability

The voice quality conversion device according to the present invention has a function of performing voice quality conversion with high quality using vocal tract information of vowel sections of a target speaker. The voice quality conversion device is useful as a user interface for which various kinds of voice quality are necessary, entertainment, and the like. In addition, the voice quality conversion device can be applied to a voice changer and the like in speech communication using a mobile telephone and the like.

The invention claimed is:

1. A voice quality conversion device that converts voice quality of an input speech using information corresponding to the input speech, said voice quality conversion device comprising:

a target vowel vocal tract information hold unit configured to hold target vowel vocal tract information of each vowel, the target vowel vocal tract information indicating target voice quality;

a vowel conversion unit configured to (i) receive vocal tract information with phoneme boundary information which is vocal tract information that corresponds to the input speech and that is added with information of (1) a phoneme in the input speech and (2) a duration of the phoneme, (ii) approximate, as a first polynomial expression, a temporal change of received vocal tract information of a vowel included in the received vocal tract information with phoneme boundary information, (iii) approximate, as a second polynomial expression, a temporal change of target vocal tract information of the vowel, the target vocal tract information being included in the target vowel vocal tract information held in said target vowel vocal tract information hold unit, (iv) approximate, as a third polynomial expression, interpolated vocal tract information of the vowel by combining (1) the first polynomial expression approximating the temporal change of the received vocal tract information of the vowel with (2) the second polynomial expression approximating the temporal change of the target vocal tract information of the vowel, and (v) convert the received vocal tract information of the vowel using the third polynomial expression approximating the interpolated vocal tract information of the vowel; and a synthesis unit configured to synthesize a speech using the converted vocal tract information of the vowel converted by said vowel conversion unit, wherein (i) the first polynomial expression approximates a change in the received vocal tract information of the vowel over time, (ii) the second polynomial expression approximates a change in the target vocal tract information of the vowel over time, and (iii) the third polynomial expression approximates a change in the interpolated vocal tract information of the vowel over time, wherein the first polynomial expression approximating the temporal change of the received vocal tract information of the vowel and the second polynomial expression approximating the temporal change of the target vocal tract information of the vowel have a same time period that overlaps over the entire time period of the vowel, and wherein said vowel conversion unit is configured to generate the third polynomial expression by adding the first polynomial expression with the second polynomial expression based on a predetermined conversion ratio.

2. The voice quality conversion device according to claim 1, further comprising a consonant vocal tract information derivation unit configured to (i) receive the vocal tract information with phoneme boundary information, and (ii) derive vocal tract information of each consonant held in the vocal tract information with phoneme boundary information, from pieces of vocal tract information of consonants having voice quality which is not the target voice quality, wherein said synthesis unit is configured to synthesize the speech using (i) the converted vocal tract information for the vowel converted by said vowel conversion unit and (ii) the derived vocal tract information of each consonant that is derived by said consonant vocal tract information derivation unit.

3. The voice quality conversion device according to claim 2, wherein said consonant vocal tract information derivation unit includes:

a consonant vocal tract information hold unit configured to hold, for each consonant held in the vocal tract information with phoneme boundary information, pieces of vocal tract information extracted from speeches of a plurality of speakers; and a consonant selection unit configured to (i) receive the vocal tract information with phoneme boundary information, and (ii) select vocal tract information of a consonant held in the vocal tract information with phoneme boundary information, from among the pieces of vocal tract information for each consonant held in the vocal tract information with phoneme boundary information, the selected vocal tract information being suitable for vocal tract information converted by said vowel conversion unit for a vowel positioned at a vowel section prior or subsequent to the consonant.

4. The voice quality conversion device according to claim 3, wherein said consonant selection unit is configured to select the vocal tract information of the consonant based on continuity between a value of the selected vocal tract information and a value of the vocal tract information converted by said vowel conversion unit for the vowel positioned at the vowel section prior to or subsequent to the each consonant.

5. The voice quality conversion device according to claim 3, further comprising a consonant transformation unit configured to transform the vocal tract information of the consonant selected by said consonant selection unit so as to improve continuity between a value of the selected vocal tract information and a value of the vocal tract information converted by said vowel conversion unit for the vowel positioned at the vowel section prior to or subsequent to the consonant.

6. The voice quality conversion device according to claim 1, further comprising a conversion ratio receiving unit configured to receive a conversion ratio representing a degree of conversion to the target voice quality, wherein said vowel conversion unit is configured to (i) receive the conversion ratio received by said conversion ratio unit and (ii) approximate, as the third polynomial expression, the interpolated vocal tract information by combining (1) the first polynomial expression approximating the temporal change of the received vocal tract information of the vowel with (2) the second polynomial expression approximating the temporal change of the target vocal tract information of the vowel at the conversion ratio received by said conversion ratio receiving unit.

7. The voice quality conversion device according to claim 6, wherein said vowel conversion unit is configured to:

(i) approximate, for each order of the first polynomial expression, the temporal change of the received vocal tract information of the vowel included in the received vocal tract information with phoneme boundary information, (ii) approximate, for each order of the second polynomial expression, a temporal change of target vocal tract information of the vowel, the target vocal tract information being included in the target vowel vocal tract information held in said target vowel vocal tract information hold unit, (iii) approximate, for each order of the third polynomial expression, the interpolated vocal tract information by combining (1) the first polynomial expression approximating the temporal change of the received vocal tract information of the vowel with (2) the second polynomial expression approximating the temporal change of the target vocal tract information of the vowel at the conversion ratio.

8. The voice quality conversion device according to claim 1, wherein said vowel conversion unit is further configured to interpolate vocal tract information of a first vowel and vocal tract information of a second vowel to be continuously connected to each other at a vowel boundary, the vocal tract information of the first vowel and the vocal tract information of the second vowel being included in a glide section that is a predetermined time period including the vowel boundary which is a temporal boundary between the vocal tract information of the first vowel and the vocal tract information of the second vowel.

9. The voice quality conversion device according to claim 8, wherein the predetermined time period is set to be longer as a duration of the first vowel and the second vowel which are positioned prior and subsequent to the vowel boundary is longer.

10. The voice quality conversion device according to claim 1, wherein the vocal tract information is one of a Partial Auto Correlation (PARCOR) coefficient and a reflection coefficient of a vocal tract acoustic tube model.

11. The voice quality conversion device according to claim 10, wherein each of the PARCOR coefficient and the reflection coefficient of the vocal tract acoustic tube model is calculated according to a polynomial expression of an all-pole model which is generated by applying Linear Predictive Coding (LPC) analysis to the input speech.

12. The voice quality conversion device according to claim 10, wherein each of the PARCOR coefficient and the reflection coefficient of the vocal tract acoustic tube model is calculated according to a polynomial expression of an all-pole model which is generated by applying Autoregressive Exogenous (ARX) analysis to the input speech.

13. The voice quality conversion device according to claim 1, wherein the vocal tract information with phoneme boundary information is generated from a synthetic speech generated from a text.

14. The voice quality conversion device according to claim 1, further comprising:

a stable vowel section extraction unit configured to detect a stable vowel section from a speech having the target voice quality; and a target vocal tract information generation unit configured to extract, from the stable vowel section, the vocal tract information as the target vowel vocal tract information, wherein said target vowel vocal tract information hold unit is configured to hold the target vowel vocal tract information that is generated by said stable vowel extraction unit and said target vocal tract information generation unit.

15. The voice quality conversion device according to claim 14, wherein said stable vowel section extraction unit includes:

a phoneme recognition unit configured to recognize a phoneme in the speech having the target voice quality; and a stable section extraction unit configured to extract, as the stable vowel section, a vowel section having a likelihood greater than a threshold value from vowel sections in the phonemes recognized by said phoneme recognition unit, the likelihood being determined by the recognition of said phoneme recognition unit.

16. The voice quality conversion device according to claim 1, wherein said target vowel vocal tract information hold unit is configured to only hold the target vowel vocal tract information for each vowel.

17. The voice quality conversion device according to claim 1, wherein the vocal tract information is one of a reflection coefficient, a linear prediction coefficient, and a line spectrum pairs coefficient.

18. A voice quality conversion method of converting voice quality of an input speech using information corresponding to the input speech, said voice quality conversion method comprising:

receiving vocal tract information with phoneme boundary information which is vocal tract information that corresponds to the input speech and that is added with information of (i) a phoneme in the input speech and (ii) a duration of the phoneme;

approximating, as a first polynomial expression, a temporal change of received vocal tract information of a vowel included in the received vocal tract information with phoneme boundary information;

approximating, as a second polynomial expression, a temporal change of target vocal tract information of the vowel, the target vocal tract information of the vowel indicating target voice quality;

approximating, as a third polynomial expression, interpolated vocal tract information of the vowel by combining (i) the first polynomial expression approximating the temporal change of the received vocal tract information of the vowel with (ii) the second polynomial expression approximating the temporal change of the target vocal tract information of the vowel;

converting the received vocal tract information of the vowel using the third polynomial expression approximating the interpolated vocal tract information of the vowel; and synthesizing a speech using the converted vocal tract information of the vowel converted in said converting, wherein (i) the first polynomial expression approximates a change in the received vocal tract information of the vowel over time, (ii) the second polynomial expression approximates a change in the target vocal tract information of the vowel over time, and (iii) the third polynomial expression approximates a change in the interpolated vocal tract information of the vowel over time, wherein the first polynomial expression approximating the temporal change of the received vocal tract information of the vowel and the second polynomial expression approximating the temporal change of the target vocal tract information of the vowel have a same time period that overlaps over the entire time period of the vowel, and wherein said approximating, as the third polynomial expression, the interpolated vocal tract information of the vowel includes generating the third polynomial expression by adding the first polynomial expression with the second polynomial expression based on a predetermined conversion ratio.

19. A non-transitory computer readable recording medium having stored thereon a program for converting voice quality of an input speech using information corresponding to the input speech, wherein, when executed by a computer, said program causes the computer to perform a method comprising:

receiving vocal tract information with phoneme boundary information which is vocal tract information that corresponds to the input speech and that is added with information of (i) a phoneme in the input speech and (ii) a duration of the phoneme;

approximating, as a first polynomial expression, a temporal change of received vocal tract information of a vowel included in the received vocal tract information with phoneme boundary information;

approximating, as a second polynomial expression, a temporal change of target vocal tract information of the vowel, the target vocal tract information of the vowel indicating target voice quality;

approximating, as a third polynomial expression, interpolated vocal tract information by combining (i) the first polynomial expression approximating the temporal change of the received vocal tract information of the vowel with (ii) the second polynomial expression approximating the temporal change of the target vocal tract information of the vowel; and converting the received vocal tract information of the vowel using the third polynomial expression approximating the interpolated vocal tract information of the vowel; and synthesizing a speech using the converted vocal tract information of the vowel converted in said converting, wherein (i) the first polynomial expression approximates a change in the received vocal tract information of the vowel over time, (ii) the second polynomial expression approximates a change in the target vocal tract information of the vowel over time, and (iii) the third polynomial expression approximates a change in the interpolated vocal tract information of the vowel over time, wherein the first polynomial expression approximating the temporal change of the received vocal tract information of the vowel and the second polynomial expression approximating the temporal change of the target vocal tract information of the vowel have a same time period that overlaps over the entire time period of the vowel, and wherein said approximating, as the third polynomial expression, the interpolated vocal tract information of the vowel includes generating the third polynomial expression by adding the first polynomial expression with the second polynomial expression based on a predetermined conversion ratio.

20. A voice quality conversion system that converts voice quality of an original speech to be converted using information corresponding to the original speech, said voice quality conversion system comprising:

a server; and a terminal connected to said server via a network, wherein said server includes:

a target vowel vocal tract information hold unit configured to hold target vowel vocal tract information of each vowel, the target vowel vocal tract information indicating target voice quality;

a target vowel vocal tract information sending unit configured to send the target vowel vocal tract information held in said target vowel vocal tract information hold unit to said terminal via the network;

an original speech hold unit configured to hold original speech information that is information corresponding to the original speech; and an original speech information sending unit configured to send the original speech information held in said original speech hold unit to said terminal via the network, wherein said terminal includes:

a target vowel vocal tract information receiving unit configured to receive the target vowel vocal tract information from said target vowel vocal tract information sending unit;

an original speech information receiving unit configured to receive the original speech information from said original speech information sending unit;

a vowel conversion unit configured to (i) approximate, as a first polynomial expression, a temporal change of received vocal tract information of a vowel included in the received original speech information received by said original speech information receiving unit, (ii) approximate a second polynomial expression, a temporal change of target vocal tract information for the vowel, the target vocal tract information for the vowel being included in the target vowel vocal tract information received by said target vowel vocal tract information receiving unit, (iii) approximate, as a third polynomial expression, interpolated vocal tract information by combining (i) the first polynomial expression approximating the temporal change of the received vocal tract information of the vowel with (ii) the second polynomial expression approximating the temporal change of the target vocal tract information of the vowel, and (iv) convert the vocal tract information of the vowel using the third polynomial expression approximating the interpolated vocal tract information; and a synthesis unit configured to synthesize a speech using the converted vocal tract information of the vowel converted by said vowel conversion unit, wherein (i) the first polynomial expression approximates a change in the received vocal tract information of the vowel over time, (ii) the second polynomial expression approximates a change in the target vocal tract information of the vowel over time, and (iii) the third polynomial expression approximates a change in the interpolated vocal tract information of the vowel over time, wherein the first polynomial expression approximating the temporal change of the received vocal tract information of the vowel and the second polynomial expression approximating the temporal change of the target vocal tract information of the vowel have a same time period that overlaps over the entire time period of the vowel, and wherein said vowel conversion unit is configured to generate the third polynomial expression by adding the first polynomial expression with the second polynomial expression based on a predetermined conversion ratio.

21. A voice quality conversion system that converts voice quality of an original speech to be converted using information corresponding to the original speech, said voice quality conversion system comprising:

a terminal; and a server connected to said terminal via a network, wherein said terminal includes:

a target vowel vocal tract information generation unit configured to generate target vowel vocal tract information of each vowel, the target vowel vocal tract information indicating target voice quality;

a target vowel vocal tract information sending unit configured to send the target vowel vocal tract information generated by said target vowel vocal tract information generation unit to said server via the network;

a voice quality conversion speech receiving unit configured to receive a speech with converted voice quality; and a reproduction unit configured to reproduce the speech with the converted voice quality received by said voice quality conversion speech receiving unit, wherein said server includes:

an original speech hold unit configured to hold original speech information that is information corresponding to the original speech;

a target vowel vocal tract information receiving unit configured to receive the target vowel vocal tract information from said target vowel vocal tract information sending unit;

a vowel conversion unit configured to (i) approximate, as a first polynomial expression, a temporal change of received vocal tract information of a vowel included in the original speech information held in said original speech information hold unit, (ii) approximate, as a second polynomial expression, a temporal change of target vocal tract information of the vowel, the target vocal tract information being included in the target vowel vocal tract information received by said target vowel vocal tract information receiving unit, (iii) approximate, as a third polynomial expression, interpolated vocal tract information by combining (i) the first polynomial expression approximating the temporal change of the received vocal tract information of the vowel with (ii) the second polynomial expression approximating the temporal change of the target vocal tract information of the vowel, and (iv) convert the received vocal tract information of the vowel using the third polynomial expression approximating the interpolated vocal tract information;

a synthesis unit configured to synthesize a speech using the converted vocal tract information for the vowel converted by said vowel conversion unit; and a synthetic speech sending unit configured to send, as the speech with the converted voice quality, the speech synthesized by said synthesis unit to said voice quality conversion speech receiving unit via the network, wherein (i) the first polynomial expression approximates a change in the received vocal tract information of the vowel over time, (ii) the second polynomial expression approximates a change in the target vocal tract information of the vowel over time, and (iii) the third polynomial expression approximates a change in the interpolated vocal tract information of the vowel over time, wherein the first polynomial expression approximating the temporal change of the received vocal tract information of the vowel and the second polynomial expression approximating the temporal change of the target vocal tract information of the vowel have a same time period that overlaps over the entire time period of the vowel, and wherein said vowel conversion unit is configured to generate the third polynomial expression by adding the first polynomial expression with the second polynomial expression based on a predetermined conversion ratio.

* * * * *